US006617706B2

(12) United States Patent
Matsubara et al.

(10) Patent No.: US 6,617,706 B2
(45) **Date of Patent: *Sep. 9, 2003**

(54) IGNITION SYSTEM

(75) Inventors: Yoshihiro Matsubara, Yokkaichi (JP); Akio Kokubu, Naogya (JP); Kazumasa Yoshida, Nagoya (JP); Makoto Yamaguchi, Owariasahi (JP); Kazuya Iwata, Gifu (JP); Shoichiro Ito, Toki (JP); Hiroshi Ono, Owariasahi (JP)

(73) Assignee: NGK Spark Plug Co., Ltd., Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/435,368

(22) Filed: Nov. 8, 1999

(65) Prior Publication Data

US 2002/0167225 A1 Nov. 14, 2002

(30) Foreign Application Priority Data

Nov. 9, 1998 (JP) ..... 10-317663
Nov. 24, 1998 (JP) ..... 10-332750

(51) Int. Cl.[7] ..... H01T 13/02
(52) U.S. Cl. ..... 307/10.1; 313/141
(58) Field of Search ..... 307/9.1, 10.1; 313/141

(56) References Cited

U.S. PATENT DOCUMENTS

| | | | | | |
|---|---|---|---|---|---|
| 5,189,333 | A | * | 2/1993 | Kagawa et al. | 313/140 |
| 5,448,130 | A | * | 9/1995 | Matsutani et al. | 313/141 |
| 5,502,351 | A | * | 3/1996 | Katoh et al. | 313/141 |
| 5,581,145 | A | * | 12/1996 | Kato et al. | 313/141 |
| 5,793,151 | A | | 8/1998 | Kagawa et al. | 313/141 |
| 5,866,972 | A | | 2/1999 | Matsubara et al. | 313/141 |
| 5,873,338 | A | * | 2/1999 | Matsubara et al. | 123/169 EL |
| 5,929,556 | A | | 7/1999 | Matsubara et al. | 313/141 |
| 5,990,602 | A | * | 11/1999 | Katoh et al. | 313/141 |
| 6,095,124 | A | * | 8/2000 | Matsubara et al. | 123/594 |
| 6,208,066 | B1 | * | 3/2001 | Kokubu et al. | 313/141 |

FOREIGN PATENT DOCUMENTS

| | | |
|---|---|---|
| EP | 0 800 247 A1 | 10/1997 |
| EP | 0 899 840 A1 | 3/1999 |
| EP | 0-758-152 | 11/2002 |
| GB | 2 327 459 A | 1/1999 |
| JP | 48-21024 | 7/1946 |
| JP | 54-32620 | 8/1952 |
| JP | 59-72689 | 5/1984 |
| JP | 60-220586 | 11/1985 |
| JP | 60-232679 | 11/1985 |
| JP | 05-121145 | 5/1993 |
| JP | 06-140124 | 5/1994 |
| JP | 6-176849 | 6/1994 |
| JP | 07-288170 | 10/1995 |
| JP | 08-222350 | 8/1996 |
| JP | 09-106881 | 4/1997 |
| JP | 9-330783 | 12/1997 |

* cited by examiner

*Primary Examiner*—Gregory J. Toatley, Jr.
(74) *Attorney, Agent, or Firm*—Morgan, Lewis & Bockius LLP

(57) ABSTRACT

An ignition system has a spark plug and a positive voltage applying unit. The spark plug includes a central electrode, a porcelain insulator for holding the central electrode, a main metallic shell for holding the porcelain insulator, and a ground electrode electrically connected to the main metallic shell. The positive voltage applying unit applies a positive voltage to the central electrode of the spark plug in comparison with the ground electrode, so that an ignition high voltage is applied between the central electrode and the ground electrode. In the spark plug, a spark discharge gap is formed between the ground electrode and a distal end portion of the central electrode. The ground electrode is positioned so that a rear edge of a mating face opposed to a peripheral side of the central electrode is positioned in the side of the distal end of the central electrode in comparison with an end face of the porcelain insulator.

12 Claims, 14 Drawing Sheets

IGNITION SYSTEM

BACKGROUND OF THE INVENTION

1. Field of the Invention

The present invention relates to an ignition system used for an igniter of an internal combustion engines, and particularly relates to an ignition system using a spark plug that can be effectively spark cleaned to have high resistance to fouling.

2. Description of the Related Art

In a parallel electrode type spark plug in which the distal end face of a central electrode opposes to a ground electrode, the voltage required is lower at the negative polarity than at the positive polarity and, hence, this type of spark plugs have been commonly used with an ignition system of negative polarity that applies a negative, high voltage to the central electrode. Accordingly, even in a semi-creep discharge type or an intermittent semi-creep discharge type of spark plugs that have a plurality of side ground electrodes provided to face the peripheral side of the central electrode, they are often used with the ignition system of negative polarity.

On the other hand, the internal combustion engine having high power and high performance, particularly the internal combustion engine for a motor cycle, has problems of breakage of the ground electrode due to mechanical vibration and excess heat of the ground electrode. It is difficult to apply the parallel electrode type spark plug to such an internal combustion engine. Further, the spark plug generally used has the main metallic shell having a small screw diameter such as M10S or M8S (JIS B8031) that is smaller than M14S. In this case, due to the size restriction of the main metallic shell, the cross sectional area of the ground electrode should be small. Consequently, the large amount of projection of the ground electrode like the parallel electrode type spark plug is difficult. Therefore, in such an internal combustion engine, a multi-electrode type spark plug in which a plurality of ground electrodes are provided so that they oppose to the peripheral side of the central electrode. In the multi-electrode type spark plug, if the ignition system in the negative polarity, it becomes a serious problem that the wearing of the central electrode which is collided with positive ions having heavy mass.

Further, since a problem of a carbon fouling during low load may easily occur, a semi-creep discharge type or an intermittent semi-creep discharge type of spark plugs have been used, in which a plurality of ground electrodes are provided to oppose to the peripheral side of the central electrode, and spark runs on the surface of the porcelain insulator between the central electrode and the ground electrode. In such a creepage spark discharge type spark plug, so-called "creepage spark discharge" occurs, in which spark runs on the surface of the porcelain insulator. Accordingly, the channeling problem on the surface of the porcelain insulator easily occur. If the channeling proceeds, the heat resistance and the reliability of the spark plug are lowered to thereby shorten the life of the spark plug.

Generally, if the diameter of the central electrode is made small, the discharge voltage is lowered to thereby improve the ignitability. However, particularly, if the diameter of the central electrode of the spark plug is small which is used for the negative ignition system, the electrode is rapidly worn and the ground electrode is partially worn. Accordingly, the life of the spark plug is shortened and it can not be used for practical use.

SUMMARY OF THE INVENTION

The present inventors found that if a specific spark plug is used, the channeling resistance of the ignition system in positive polarity in which positive voltage is applied to the central electrode is superior in comparison with the general ignition system in negative polarity.

It is an object of the present invention to provide an ignition system used for high-power and high-performance internal combustion engines, capable of preventing the breakage and the excessive heating of the spark plug used therein, the system having excellent ignitability, high durability and long life. Further, it is another object of the present invention to provide an ignition system in which the fouling resistivity and ignitability of the spark plug used therein, and it is strong against the channeling to thereby elongate its life.

According to the first aspect of the present invention, an ignition system comprises: a spark plug comprising a central electrode, an porcelain insulator for holding the central electrode, a main metallic shell for holding the porcelain insulator, and a ground electrode electrically connected to the main metallic shell; and a positive voltage applying unit for applying a positive voltage to the central electrode of the spark plug in comparison with the ground electrode, so that an ignition high voltage is applied between the central electrode and the ground electrode; wherein a spark discharge gap is formed between the ground electrode and a distal end portion of the central electrode; and the ground electrode is positioned so that a rear edge of a mating face opposed to a peripheral side of the central electrode is positioned in the side of the distal end of the central electrode in comparison with an end face of the porcelain insulator.

In this ignition system, wherein the positive voltage applying unit may comprise an ignition coil having a primary coil and a secondary coil, and a primary current flowing in the primary coil of the ignition coil is stopped at a predetermined ignition period so as to apply the ignition high voltage is applied between the central electrode and the ground electrode of the spark plug. Further, in this ignition system, the positive voltage applying unit may further comprise a electric power source connected to the primary coil of the ignition coil and a control unit for controlling the ignition period of the primary current.

With this design, more of the spark jumps that are created by application of high voltage occur anywhere but along the surface of the porcelain insulator. In particular, according to an experiment on spark plugs that were operated with positive high voltage being applied to the central electrode, an appreciably increased proportion of the spark jumps occurred at the tip of the central electrode which was distant from the surface of the porcelain insulator. This enabled the spark plugs to be fired efficiently. What is more, the proportion of spark jumps along the surface of the porcelain insulator decreased dramatically during normal service and the chance of the spark of damaging the surface of the porcelain insulator is correspondingly reduced to make the spark plugs more resistant to channeling.

FIGS. 24 and 25 are section views of the distal end portion of a spark plug, showing how individual parts of the spark plug are electrified. FIG. 24 refers to the case of the present invention in which positive high voltage is applied to central electrode 2, and FIG. 25 refers to the conventional case where negative high voltage is applied to central electrode 2.

First, in the case of the present invention where central electrode 2 has positive polarity, the surface of porcelain insulator 1, particularly its end face, becomes negatively charged by dielectric polarization (see FIG. 24). As a result, the electric field near the front edge 11A of ground electrode 11 becomes stronger than the electric field near the rear edge 11B and spark is produced from the front edge 11A more frequently than from the rear edge 11B. However, the spark frequently produced at the front edge 11A is so much distant from the porcelain insulator 1 that channeling and other unwanted phenomena are less likely to occur.

Secondly, even if spark is produced at the rear edge 11B of the ground electrode 11, the negatively charged particles (e.g., electrons) that make up the greater part of the spark are repelled by the negative charge on the surface of the porcelain insulator 1 and the spark is more to prone to flash at a distance from the porcelain insulator 1 due to electrostatic repulsion. This lowers the probability of the occurrence of spark propagation along the surface of the porcelain insulator 1 and channeling due to spark attack is less likely to occur. On the other hand, in the conventional case operating at negative polarity, the surface of the porcelain insulator 1 becomes positively charged (see FIG. 25). As a result, spark is more prone to be attracted toward the surface of the porcelain insulator 1, increasing the chance of the occurrence of channeling.

The third factor to be considered is the difference in the mode of corona discharge that is a precursor to spark discharge. Spark discharge is usually preceded by corona discharge. It is generally held that the mode of corona discharge governs the behavior of the subsequently occurring spark discharge. Corona discharge behaves differently at positive and negative terminals. Take, for example, the case where a needle electrode opposed to a planer electrode is supplied with an increasing positive voltage. At low-voltage stage, only glow discharge occurs. As the applied voltage increases, the glowing tree stretches from the pointed tip of the needle electrode and moves briskly with hissing sound to make a shift to brush discharge. The first stage of brush discharge is brush corona, which develops into streamer corona more like spark discharge. If the needle electrode is supplied with negative voltage, the mode of discharge does not change as sharply as described above; with increasing voltage, a mode of discharge like glow corona is sustained near the pointed tip of the needle electrode and a glowing tree is not likely to appear.

This theory may be applied to describe the discharge that occurs between electrodes in a spark plug. First consider the conventional art case shown in FIG. 25 with negative voltage applied to the central electrode 2. The edges 11A and 118 of the ground electrode 11 may each be regarded as a positive pointed tip corresponding to the needle electrode. Brush discharge first occurs and the corona stretching from these edges reaches the central electrode 2 to cause "breakdown" in spark discharge. Since the highest field intensity occurs near the rear edge 11B, the discharge path completed by the corona extending from that edge 11B is most likely to run along the surface of the porcelain insulator 1.

If the central electrode 2 is supplied with positive voltage as in the case of the present invention shown in FIG. 24, the front edge 2A of the central electrode 2 may be regarded as a positive pointed tip that corresponds to the needle electrode and the corona stretching from that edge reaches the ground electrode 11 to cause "breakdown". Since the ground electrode 11 is separated from the porcelain insulator 1 by the air, the concentration of the applied field is less subject to the influences of the surface charges on the porcelain insulator 1. Therefore, the discharge path completed by the corona somewhat "floats", above the porcelain 1 to reduce the likelihood of channeling due to spark attack.

The fourth difference between FIGS. 24 and 25 is that the porcelain insulator 1 is damaged by different degrees depending on the direction of corona stretching. In the conventional art case shown in FIG. 25, corona stretches from the ground electrode 11 and the porcelain insulator 1 is directly subjected to the stress of intense field, increasing the chance of perforation (cavitation) of the porcelain insulator 1 by ion collision. On the other hand, in the case of the invention shown in FIG. 24, corona stretches from the central electrode 2 in contact with the porcelain insulator 1 and, in addition, the field on the porcelain insulator I is attenuated; this would reduce the likelihood of perforation of the porcelain insulator, thereby making it more resistant to channeling.

According to the second aspect of the present invention, the distal end portion of the central electrode, where the peripheral side of the central electrode is opposed to the ground electrode, preferably has a diameter of 2.0 mm or less.

With this design, in case of generating the creepage spark discharge, the spark clean efficiency for cleaning carbon fouling is improved, thereby improving the anti-fouling property. Further, if the endurance test is performed by using an ignition system in which the positive high voltage is applied to the central electrode of the multi-electrode spark plug, the electrode wear is remarkably decreased in comparison with the ignition system with negative polarity. The reason may be considered as follows. During discharge, positive ion existing between the discharge gap moves to the negative electrode and collides with it, and negative ion or electron moves to the positive electrode and collides with it. Positive ion is extremely heavier than negative ion or electron. Accordingly, the amount of the wear generated by the collision at the negative electrode with which positive ion collides is much larger than that at the positive electrode, as well as the temperature of the negative electrode is apt to be increased. If the central electrode is used with the negative polarity, the durability of the electrode, the diameter of which is less than 2 mm, is suddenly decreased. On the other hand, if the central electrode is used with the positive polarity, there is no such a trend. Consequently, the central electrode with the positive polarity can obtain the durability which is equal to or more than that of the central electrode having the diameter of 2 mm or more in the negative polarity. If the diameter of the central electrode is 1.9 mm or less, the effect of the positive polarity largely appears. Incidentally, if the central electrode is made too thin, it is excessively heated because of break of the balance between receiving heat and discharging heat. Accordingly, the diameter of the central electrode is desirably 0.4 mm or more, and more preferably, in the range of 0.6 mm to 1.8 mm.

Then, because the multi-electrode spark plug in which the required voltage necessary for spark discharge does not change much, it is possible to maintain low discharge voltage corresponding to the thin central electrode. Since the central electrode is thin, the ignitability is improved and the ground electrode is worn uniformly not unevenly. Further, the ground electrode is opposed to the peripheral side face of the central electrode, the projection amount of the ground electrode from the main metallic shell can be small, thereby preventing the breakage and excessive heating of the ground electrode.

According to the third aspect of the present invention, the diameter of the distal end portion of the central electrode is preferably in the range of 0.6 mm to 1.8 mm.

According to the fourth aspect of the present invention, the shortest distance (G) from the mating face of the ground electrode to the central electrode is preferably at least 1.5 times as long as the shortest distance (L) from the ground electrode to the porcelain insulator ($1.5L \leqq G$).

If the end face of the porcelain insulator is fouled by carbon in this design ($1.5L \leqq G$), the probability of creep discharge by a spark jump from the ground electrode to the end face of the porcelain insulator is increased and so is the probability that the carbon-fouled end face of the porcelain insulator is effectively spark cleaned. Hence, the spark plug is rendered highly resistant to fouling.

According to the fifth aspect of the present invention, the distal end face of the central electrode is preferably located between the front and rear edges of the mating face of the ground electrode.

With this design, the probability that spark jumps at the tip of the central electrode upon application of high voltage is so much increased that the firing efficiency of the spark plug is further improved. Further, the ground electrode is uniformly worn but is not worn unevenly much.

According to the sixth aspect of the present invention, the shortest distance (L) from the ground electrode to the porcelain insulator is preferably between 0.3 mm and 0.6 mm ($0.3 \leqq L \leqq 0.6$), and the shortest distance (G) from the mating surface of the ground electrode to the peripheral side of the central electrode is $G \leqq (2/3)L+1.0$ (in millimeters).

Since $0.3 \leqq L$, the chance of the occurrence of so-called carbon bridge (a carbon lump or the like deposits between the porcelain insulator and the ground electrode to cause a short-circuit problem) is eliminated. on the other hand, $L \leqq 0.6$, so the susceptibility to spark cleaning by creep discharge is by no means impaired. Further, it was verified by experiment that by satisfying the condition of $G \leqq (2/3)L+1.0$ (in millimeters), the occurrence of spark jumps along the end face of the porcelain insulator can be reduced to attenuate channeling.

The reason for the attenuation of channeling may be explained as follows. If a sparkplug is installed on the actual engine and operated in a racing mode (engines runs at full speed under no load), the pressure in cylinders may sometimes become as high as 5 atmospheres when the spark plug fires a spark. The effect of pressure on discharge voltage is smaller in creep discharge along the surface of the porcelain insulator than in aerial discharge; therefore, under the contemplated high-pressure condition, spark jumps are likely to occur along the end face of the porcelain insulator even if its surface is not fouled by carbon. It should particularly be noted that under the contemplated high-pressure condition, more of the spark discharge that occurs is capacity-related to thereby provide high spark energy density. The spark of high energy density produces a greater amount of channeling and, hence, deeper channeling than the spark created under a low-pressure condition. Therefore, the occurrence of spark jumps along the surface of the porcelain insulator which in no way contribute to clean carbon fouling by spark is not preferred from an anti-channeling viewpoint. It has been found by experiment that if the shortest distance (L) from the mating surface of the ground electrode to the porcelain insulator and the shortest distance (G) from the mating surface of the ground electrode to the peripheral side of the central electrode are set to satisfy the relationship $G \leqq (2/3)L+1.0$ (in millimeters), the occurrence of spark jumps along the surface of the porcelain insulator at high pressure can be effectively reduced.

According to the seventh aspect of the present invention, the central electrode preferably has a spark wear resistant member in at least a part of its distal end portion.

The spark wear resistant member may be made of any noble metal materials having higher melting points than Inconel which is a highly corrosion-resistant nickel alloy commonly used as an electrode material. Stated specifically, the spark wear resistant member may be made of noble metals, noble metal alloys, sintered noble metals and so forth that are exemplified by platinum (Pt), platinum-iridium (Pt—Ir), platinum-nickel (Pt—Ni), platinum-iridium-nickel (Pt—Ir—Ni), platinum-rhodium (Pt—Rh), iridium-rhodium (Ir—Rh), iridium-yttria (Ir—$Y_2O_3$), etc.

With this design, the distal end portion of the central electrode where most of the spark jumps occur wears less and the life of the spark plug is accordingly prolonged. In addition, the tip of the central electrode is prevented from wearing to such an extent that it becomes less angular to have round edges and the concentration of spark jumps at the tip of the central electrode is accordingly maintained.

According to the eighth aspect of the present invention, the spark wear resistant member on the central electrode preferably extends to a position more rearward of the rear edge of the mating face of the ground electrode.

With this design, even if the spark jump from the ground electrode is flown to a position rearward of the spark plug by strong air flow in a combustion chamber, the spark jump achieved to the central electrode arrives at a portion where the spark wear resistant member exists to thereby prevent to wear the central electrode.

According to the ninth aspect of the present invention, the ground electrode preferably has a spark wear resistant member in at least a part of its mating face.

With this design, the mating face of the ground electrode positioned opposite the side of the central electrode to serve as a jump sparking face will wear less and the life of the spark plug is accordingly prolonged.

PREFERRED EMBODIMENTS OF THE INVENTION

Preferred embodiments of the present invention will be described as follows referring to the accompanying drawings.

Figure 1:
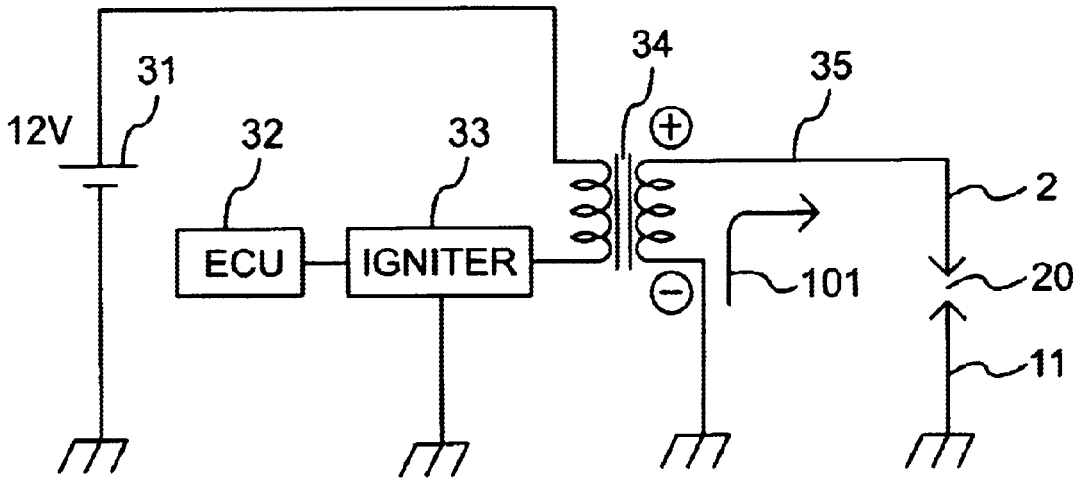
FIG. 1 is a circuit diagram of a firing system operating with positive polarity according to the present invention.
Figure 2:
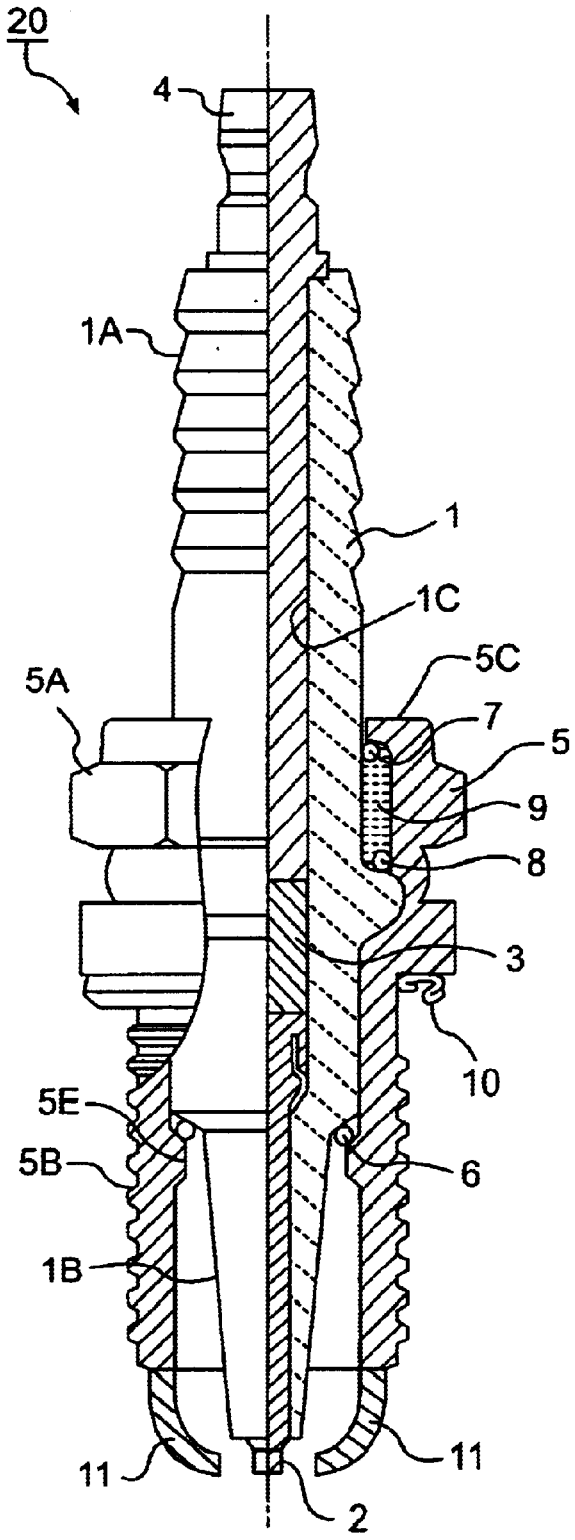
FIG. 2 is a partial cross section view of a spark plug used in the present invention.

FIG. 1 is a circuit diagram of a firing system operating with positive polarity according to the present invention. FIG. 2 is a partial cross section view of a spark plug 20 used in the present invention. A battery 31 is connected to the primary of an ignition coil 34 at one end, with the other end of the primary being grounded via an igniter 33. The igniter 33 is connected to and controlled by an engine control computer unit (ECU) 32. The secondary of the ignition coil 34 is grounded at the negative terminal, not at the usual positive terminal. The positive terminal of the secondary is connected to a spark plug 20 via a high-voltage withstanding cable 35. The spark plug 20 may be according to any one of the first to fourteenth embodiments described below.

The engine control computer unit (ECU) 32 sends appropriately timed pulse signals to the igniter 33 so that a current flows through the primary of the ignition coil 34 for a few milliseconds and then stops flowing. As a result, a high positive voltage develops at the positive terminal of the secondary of the ignition coil 34. The generated high positive voltage passes through the cable 35 to be impressed on the central electrode 2 of the spark plug 20, whereupon the air insulation between the central electrode 2 and the ground 11 is disrupted to produce a spark discharge which, in turn, causes a discharge current to flow in the direction indicated by arrow 101.

The spark discharge described above is of positive polarity, the spark plug allows the central electrode 2 to wear very slowly and it has high durability.

Next, the description will be made about the spark plug 20 used in the ignition system according to the present invention. As is well known, a porcelain insulator 1 typically made of alumina or other ceramics has a corrugation 1A in the upper part for ensuring an adequate creep distance and a leg portion 1B in the lower part that is to be exposed in the combustion chamber of an internal combustion engine. A center through-hole 1C extends through the center of the shaft. A central electrode 2 made of a nickel alloy such as Inconel is retained at the bottom end (distal end) of the center through-hole 1C such that it projects downward from the bottom end face of the porcelain insulator 1. In practice, the central electrode 2 is not solely composed of Inconel but has a core of copper (cu) fitted into the center with a view to providing better heat conductivity. The copper core is not shown in FIG. 2 to avoid complexity. The central electrode 2 is electrically connected to an upper terminal 4 via a glass resistor 3 provided within the center through-hole 1C. A high-voltage withstanding cable (not shown) is connected to the terminal 4 and high voltage is applied through the cable. The porcelain insulator 1 is supported within the main metallic shell 5.

The main metallic shell 5 is made of a low-carbon steel material and has a hexagonal portion 5A that engages a spark plug wrench and a thread portion 5B which can be threaded into a cylinder head. The main metallic shell 5 also has a clamp portion 5C on which the main metallic shell 5 is clamped to become integral with the porcelain insulator 1. To ensure complete seal by the clamping operation, a sheet of packing member 6 is provided between a recessed step 5E in the main metallic shell 5 and the porcelain insulator 1, whereby the leg portion 1B to be exposed in the combustion chamber is completely isolated from the upper part of the porcelain insulator 1. Wires of seal member 7 and 8 are provided between the clamp portion 5C and the porcelain insulator 1 and the powder of talc 9 is packed between the two seal members 7 and 8 so that it works as an elastic sealant to ensure that the porcelain insulator 1 is completely secured to the main metallic shell 5. Needless to say, the talc 9 may be omitted to produce a talc-free spark plug. A gasket 10 is squeezed at the top end of the thread portion 5B. Two ground electrodes 11 made of a nickel alloy are welded to the bottom end of the main metallic shell 5. Each of the ground electrodes 11 is so formed that its mating end face is opposed to the peripheral side of the central electrode 2.

Figure 3:
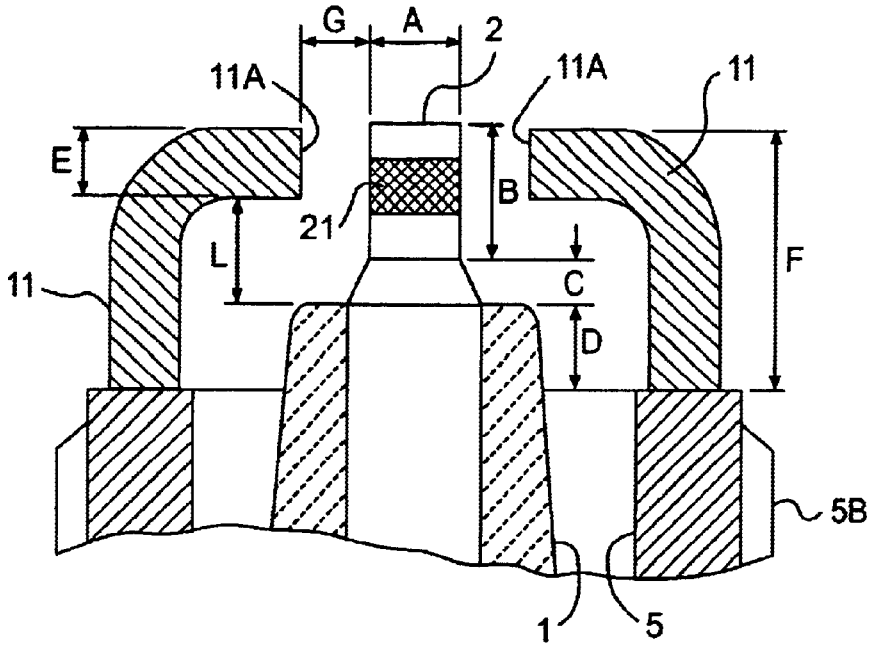
FIG. 3 is a sectional view showing enlarged the distal end portion of a spark plug used in the ignition system according to the first embodiment of the invention.
Figure 15:
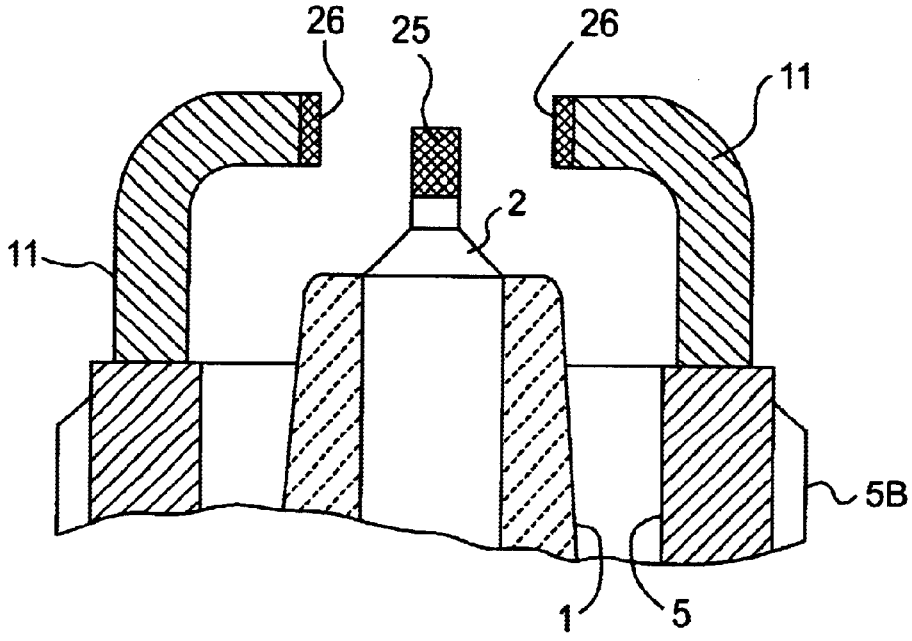
FIG. 15 shows in section the distal end portion of a spark plug used for the ignition system according to the seventh embodiment of the present invention.

FIG. 3 is a sectional view showing enlarged the distal end portion of a spark plug used in the ignition system according to the first embodiment of the invention. The tip of the spark plug shown at the bottom of FIG. 2 is inverted in FIG. 3 and 15 shown at the top. That part of the central electrode 2 which is just above the porcelain insulator 1 is tapered so that its distal end portion has a smaller diameter. The entire part of the central electrode 2 that lies above the porcelain insulator 1 is not reduced in diameter but instead the base is thicker than the distal end portion; this is in order to ensure that the heat generated on the central electrode 2 is effectively dissipated to prevent its distal end portion from becoming overheated. A spark wear resistant member 21 in platinum (Pt) is laser welded to the peripheral side of the smaller-diameter, distal end portion of the central electrode 2. The two ground electrodes 11 are positioned diametrically to each other and project from the end face of the main metallic shell 5 toward their distal end. The distal end portion of each ground electrode 11 is bent by 90 degrees such that its mating end face 11A is opposed to the peripheral side of the central electrode 2. The spark wear resistant member 21 provided on the smaller-diameter portion of the central electrode 2 covers a comparatively wide area such that the edge of its lower end is positioned at the rear side (downward in FIG. 3) in comparison with the position corresponding to the edge on the rear side (down in FIG. 3) of the end face 11A of each ground electrode 11.

Details about the dimensions of the distal end parts of the spark plug are given below. The smaller-diameter portion at the distal end of the central electrode 2 has diameter A which takes either one of these five values: 0.6 (in millimeters, which applies in the following description of dimensions), 1.2, 1.8, 2.0 and 2.5. Thus, five samples of sparkplug are provided. The smaller-diameter portion of the central electrode 2 has length B which is 2.5; the tapered portion has length C which is 1.0; the porcelain insulator 1 projects from the main metallic shell 5 by length D which is 2.5. The end face 11A of each ground electrode 11 has a rectangular cross section with a thickness E of 1.6 and a width W (not shown) of 2.7; each ground electrode 11 projects from the main metallic shell 5 by length F which is 6.0. Hence, the most distal end of the central electrode 2 coincides in position with the edge on the front side of each ground electrode 11. The air gap G between the peripheral side of the central electrode 2 and the end face 11A of each ground electrode 11 is adjusted to have a setting of 1.1. The thread portion 5B of the main metallic shell 5 has a standard diameter M14S.

These samples were subjected to on-board endurance tests to evaluate their durability in a high-speed pattern, using an in-line, 6-cylinder, 2-L engine at speeds of 3000–5500 rpm (corresponding to an average car speed of 140 km/h) for 700 h. The experiments simulated driving for a distance of about 100,000 km. The results of the on-board endurance tests are shown in four graphs (FIGS. 4 to 7). Symbol ● refers to the spark plug with A=0.6, symbol ■ refers to the spark plug with A=1.2, and symbol ♦ refers to the spark plug with A=1.8. The other symbols, Δ and ○, refer to the spark plugs with A values of 2.0 and 2.5, respectively.

Figure 4:
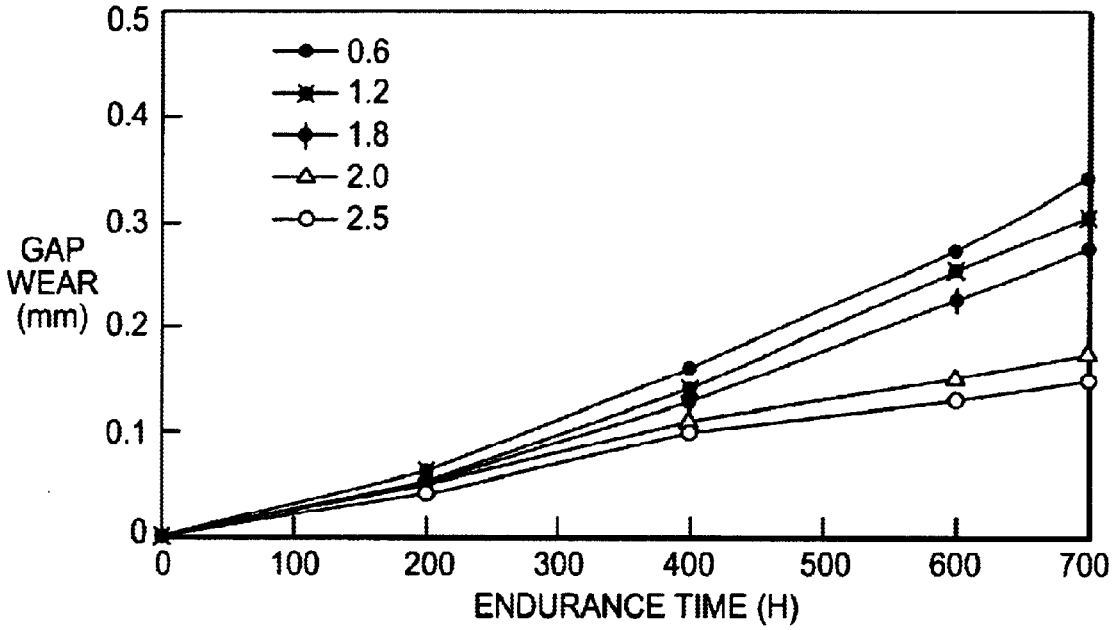
FIG. 4 is a graph showing the gap wear that occurred in the five spark plug samples when high negative voltage was applied to the central electrode in the usual manner.

FIG. 4 is a graph showing the gap wear that occurred in the five spark plug samples when high negative voltage was applied to the central electrode in the usual manner. The horizontal axis of the graph plots the endurance test time (in hours) and the vertical axis plots the amount of gap wear (in millimeters, representing the increase in the air gap G). As is clear from FIG. 4, the spark plug samples of the invention referred to by the solid symbols ●, ■ and ♦ experienced a markedly accelerated gap wear after the passage of 400 h and at the end of the test (700 h later), the gap wear was very different from the values for the samples using thick central electrodes that are referred to by the open symbols. It is therefore concluded that the spark plugs using thin central electrodes with diameter A being 1.8 mm or smaller are not suitable for commercial operation at negative polarity on account of the excessive gap wear.

Figure 5:
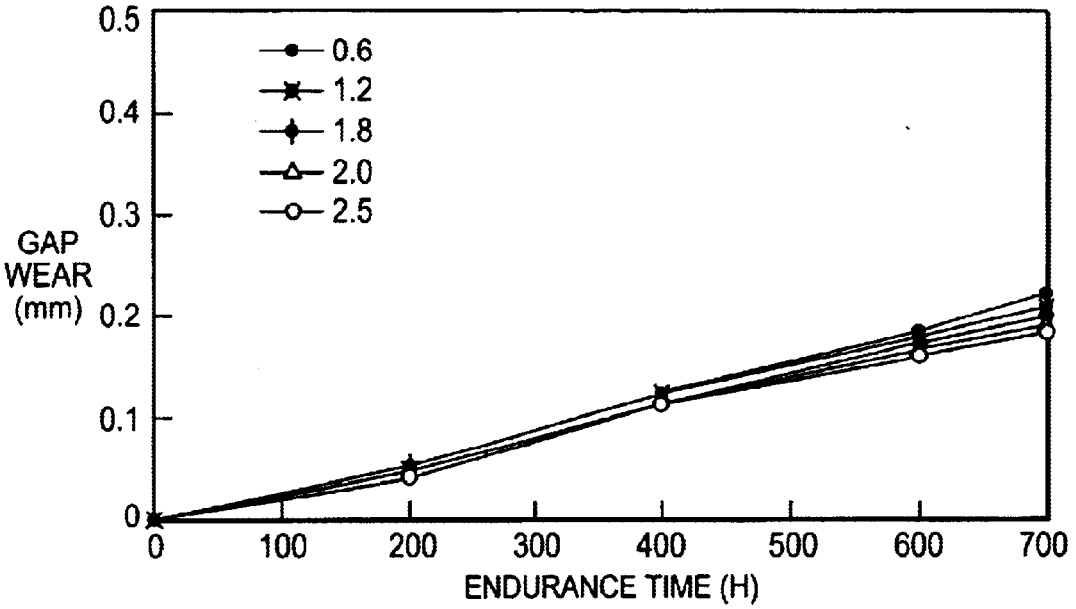
FIG. 5 is a graph showing the gap wear that occurred in the five spark plug samples when high positive voltage was applied to the central electrode.

FIG. 5 is a graph showing the gap wear that occurred in the five spark plug samples when high positive voltage was applied to the central electrode. The designations of the horizontal and vertical axes are the same as defined for FIG. 4. In the operation at positive polarity, the values of gap wear did not vary greatly with the diameter A of the central electrode and as the endurance test time increased, the gap wear increased at generally the same rate in the five spark plug samples. After the passage of 700 h, the general tendency remained the same and the gap wear increased with the decreasing diameter of the central electrode; however, the difference was small and the gap wear was no more than 0.2 mm in the five test samples. It is therefore concluded that even the spark plugs using thin central electrodes with diameter A being 1.8 mm or smaller experience less gap wear to be capable of operating with greater durability if positive, not negative, voltage is applied to the central electrode.

Figure 6:
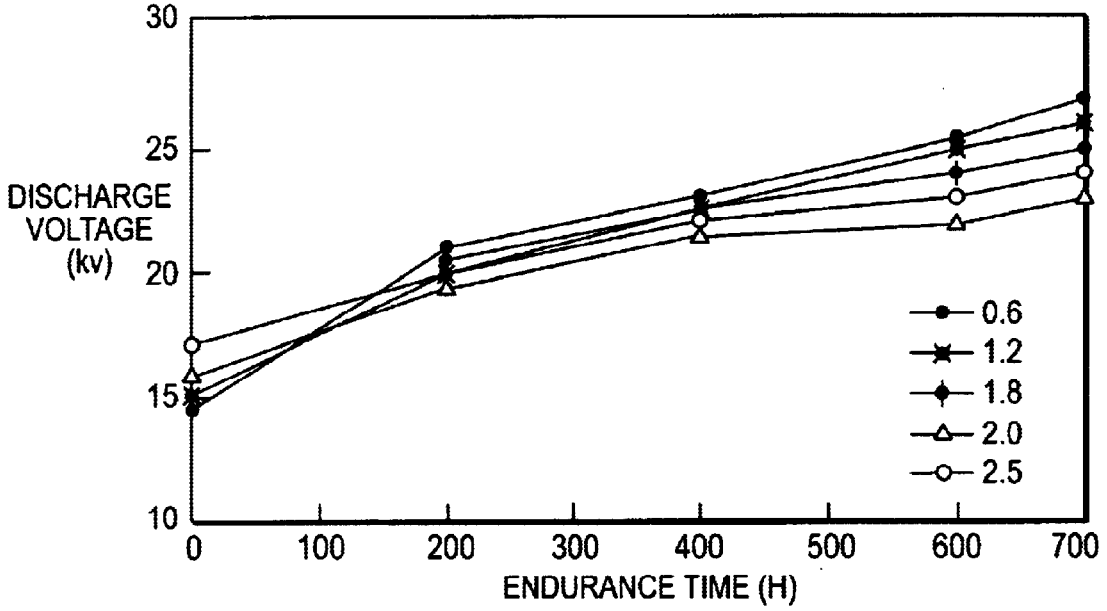
FIG. 6 is a graph showing the change in discharge voltage that occurred in five spark plug samples when they were operated with negative polarity in the usual manner.

FIG. 6 is a graph showing the change in discharge voltage that occurred in the five spark plug samples when they were operated with negative polarity in the usual manner. The discharge voltage was measured in terms of the instantaneous value that occurred during "idle racing" with the engine run under no load. The unit of discharge voltage measurement was kV (kilovolts). In a new state (the endurance test time was zero hours), the discharge voltage decreased with the decreasing diameter A of the central electrode. However, as the engine was run for 200 h, the tendency reversed and the discharge voltage increased with the decreasing diameter A. The difference widened as the engine was run for 700 h and the samples using thin central electrodes with small values of A required discharge voltages in excess of 25 kV.

Figure 7:
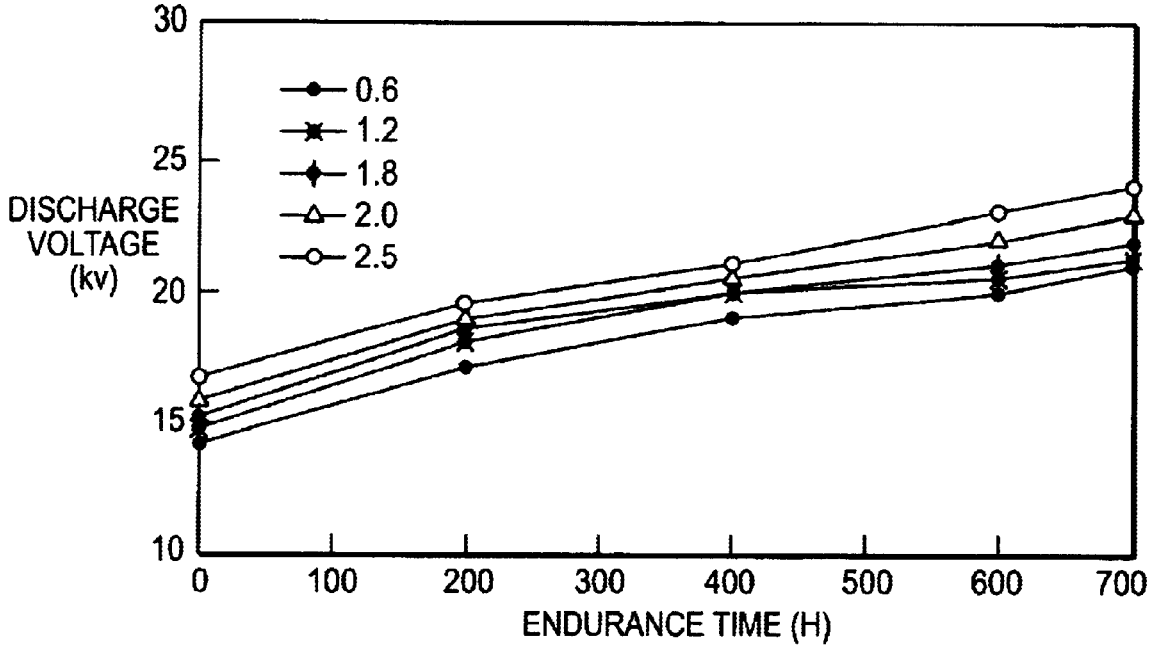
FIG. 7 is a graph showing the change in discharge voltage that occurred when the five spark plug samples were operated with positive polarity.

FIG. 7 is a graph showing the change in discharge voltage that occurred when the five spark plug samples were operated with positive polarity. The designations of the horizontal and vertical axes were the same as defined for FIG. 6. In the operation with positive polarity, the characteristics of the virgin state (the discharge voltage decreases with the decreasing diameter A of the central electrode) were maintained after the passage of 700 h of driving and the reversal of the tendency (see FIG. 6) was absent. The discharge voltage increased with the increasing time of endurance test but at a relatively slow rate. Even at the end of the test (after the passage of 700 h), the spark plugs using thin central electrodes with small values of diameter A required lower discharge voltages than the samples using large values of diameter A. Briefly, even after the prolonged endurance test, the spark plugs of the invention that were operated with positive polarity, rather than the normal negative polarity, using thin central electrodes with diameter A being 1.8 mm or less could maintain relatively low discharge voltages. This demonstrates the improved durability of the spark plugs.

Next, regarding to the spark plug whose central electrode 2 has the diameter A of 1.8 mm of those five kinds of spark plugs, the temperature of the central electrode was measured in case of both positive polarity and negative polarity. The results are shown in Table 1. This test was performed in a condition that a spark plug was mounted to a chamber tester on a desk, and the inner pressure was increased to 6 atm. Then, an ignition electric source for a vehicle was used so that the spark plugs in positive and negative polarity were discharged with the cycle of 60 times/sec. and 100 times/sec., respectively.

TABLE 1

| Frequency | Temperature | |
|---|---|---|
| (Hz) | Positive (° C.) | Negative (° C.) |
| 60 | 50 | 150 |
| 100 | 70 | 240 |

The spark plug was operated with the positive polarity, so that the temperature of the central electrode can be lowered in comparison with that of the conventional spark plug operated with the negative polarity. This is one of factors for surprising to consume the central electrode and increase the discharge voltage.

Further, regarding to the spark plug whose central electrode 2 has the diameter A of 1.8 mm of those five kinds of spark plugs, the ignitability was measured in case of both positive polarity and negative polarity, respectively. The results are shown in Table 2. Table 2 shows the air fuel ratio (A/F) of the ignition limitation before and after the 700 h endurance tests as described above. The air fuel ratio (A/F), which becomes the ignition limitation, is an air fuel ratio (A/F) where misfire ratio becomes 1%. An in-line, 6-cylinder, 2-L engine was used, and the measurement was performed at idling operation of 700 ppm. Simultaneously, the spark jump positions of the central electrode 2 and the ground electrode 11 were confirmed. In Table 2, the spark jump ratio is a ratio of a case where the spark jump was generated between the central electrode and the distal end side of the ground electrode.

TABLE 2

| | Ignition limitation | | | |
|---|---|---|---|---|
| | Positive polarity | | Negative polarity | |
| | Air fuel ratio | Spark jump ratio (%) | Air fuel ratio | Spark jump ratio (%) |
| Before endurance test | 17.2 | 100 | 16.8 | 90 |
| After endurance test | 17.3 | 100 | 16.5 | 60 |

In case of the positive polarity, because of its electrical characteristic, spark jump was generated between the central electrode and the distal end side of the ground electrode in 100%. Accordingly, the ignition limitation is remarkably improved in the positive polarity. Further, even after the endurance test, since the wearing of the edge of the central electrode is small, spark jump was generated between the central electrode and the distal end side of the ground electrode in 100%. Accordingly, in case of the negative polarity, the air fuel ratio as the ignition limitation is lowered, but in case of the positive polarity, there is little change of the air fuel ratio.

Further, regarding to the spark plug whose central electrode 2 has the diameter A of 1.8 mm of those five kinds of spark plugs, the ignitability was measured with the positive polarity in case that the direction of the ground electrode is parallel or vertical to a swirl. The direction A means a direction vertical to the swirl, and the direction B means a direction parallel to the swirl. The air fuel ratio (A/F), which becomes the ignition limitation, is an air fuel ratio (A/F) where a misfire ratio becomes 1%. An in-line, 6-cylinder, 2-L, lean burn engine was used, and the measurement was performed at an engine operation condition corresponding to 60 km/h.

TABLE 3

| | Ignition limitation air fuel ratio |
|---|---|
| Direction A | 22.6 |
| Direction B | 21.6 |

The direction A, in which the ground electrode is positioned in vertical to the swirl, further improves the ignitability. This is because the following reasons. An air fuel mixture forms the swirl in a combustion chamber. The spark jumping between the electrodes of the spark plug contacts with the air fuel mixture moved by the swirl, so that the air fuel mixture is ignited and burned. At this time, if the ground electrode is positioned to be parallel to the swirl, the ground electrodes shields against the flow direction of the swirl, so that the air fuel mixture is hard to contact with the spark. Further, flame kernel generated between a gap abuts the electrode. Thus, the heat drawing by the electrode occurs to thereby obstruct the growth of the flame kernel. On the other hand, the ground electrode is vertical to the swirl, the ground electrode does not shield the flow of the swirl, thereby improving the ignitability. In addition, the swirl direction in the spark plug position is almost the same direction from low speed to high speed. Accordingly, if the direction of the ground electrode is set to be vertical to the swirl in one condition, good ignitability can be exhibited from low speed to high speed.

Figure 8:
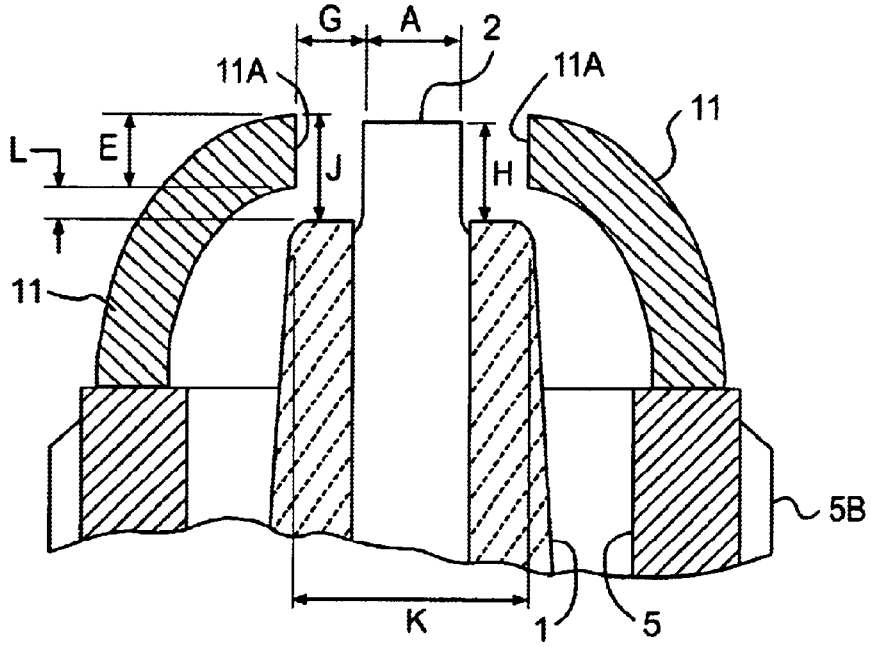
FIG. 8 is a sectional view showing enlarged the distal end portion of a spark plug used in the ignition system according to the second embodiment of the invention.

FIG. 8 is a sectional view showing enlarged the distal end portion of a spark plug used in the ignition system according to the second embodiment of the invention. The two ground electrodes 11 made of 95% of Ni are positioned diametrically to each other and the mating surface 11A of each ground electrode 11 is opposed to the peripheral side of the central electrode 2. Each ground electrode 11 is disposed such that the rear edge of the end face 11A (downward in FIG. 8) is disposed in the side of the distal end (upward in FIG. 8) in comparison with the end face of the porcelain insulator 1. In addition, the shortest distance L from the end face 11A of the ground electrode 11 to the porcelain insulator 1 is adjusted to be smaller than the shortest distance a from the end face h A of the ground electrode 11 to the peripheral side of the central electrode 2.

Details about the dimensions of the distal end parts of the spark plug are given below. The central electrode 2 has diameter A which takes the value 2.0 (in millimeters, which applies in the following description of dimensions) and it projects from the porcelain insulator 1 by length HI which is either 1.8 or 2.2. Thus, two samples of spark plug are provided.

The end face of the porcelain insulator 1 has a diameter K of 46. The distance J from the end face of the porcelain insulator 1 to the foremost edge (upward in FIG. 8) of the distal end 11A of the ground electrode 11 (J is hereunder referred to as the amount of projection J of the ground electrode) is set at 2.1; the thickness E of the ground electrode 11 (or the distance from the upper edge of the end face 11A to its lower edge) is set at 1.6; the distance L from the lower edge of the end face 11A of the ground electrode 11 to the end face of the porcelain insulator 1 (L is hereunder referred to as the semi-creep discharge air gap L) is set at 0.5; the distance G from the end face 11A of the ground electrode 11 to the peripheral side of the central electrode 2 (is hereunder referred to as the side electrode air gap G) is set at 1.3.

Thus, the spark plug of the embodiment under consideration has a plurality of ground electrodes 11, with the end face 11A of each ground electrode 11 being opposed to the peripheral side of the central electrode 2. The rear edge of the end face 11A of each ground electrode 11 is positioned in the side of the distal end of the central electrode in comparison with the end face of the porcelain insulator 1 (L=0.5). In addition, the shortest distance L (=0.5) from the end face 11A of each ground electrode 11 to the porcelain insulator 1 is smaller than the shortest distance G (=1.3) from the end face 11A of each ground electrode 11 to the peripheral side of the central electrode 2. Further, in addition, the distal end face of the central electrode 2 is located between the front and rear edges of the end face 11A of each ground electrode 11 but closer to the front edge (J=2.1 as compared to H=1.8–2.2). To evaluate the jump spark characteristics of this spark plug, an experiment was performed with positive or negative voltage being applied to the central electrode 2. The results are shown in Table 4 below.

TABLE 4

| Polarity of central electrode | Amount of central electrode projection (H) | Amount of ground electrode projection (J) | Spark jump at the tip of central electrode | Spark jump in semi-creep surface discharge during smothering |
|---|---|---|---|---|
| − | 2.2 mm | 2.1 mm | 30% | 100% |
| + | 2.2 mm | 2.1 mm | 70% | 100% |
| + | 1.8 mm | 2.1 mm | 100% | 100% |

As is clear from Table 4, only 30% of the spark jumps created upon application of high negative voltage to the central electrode 2 occurred at its tip; however, when high positive voltage was applied to the central electrode 2, as much as 70% of the spark jumps created occurred at the tip of the central electrode 2, which was more than twice the value obtained in the first case. In the sample where H was adjusted to 1.8 so that the foremost end of the central electrode 2 would not go beyond the front edge of the end face 11A of each ground electrode 11 (J=2.1), all of the spark jumps created occurred at the tip of the central electrode. Thus, the ratio of spark jumps that occur at the tip of the central electrode 2 can be markedly improved by supplying it with positive voltage. If the ratio of spark jumps at the tip of the central electrode is increased, the efficiency of spark plug firing is correspondingly improved; at the same time, the occurrence of semi-creep discharge (spark runs along the end face of the porcelain insulator 1) is sufficiently suppressed to reduce the probability that the surface of the porcelain insulator is grooved by channeling. In other words, the spark plug has high resistance to channeling.

On the other hand, when the spark plug was "smothering" due to carbon fouling, all spark jumps occurred in a semi-creep discharge mode. This is probably because the semi-creep discharge air gap L (=0.5) was smaller than the side electrode air gap G (=1.3). That is, spark cleaning action developed to burn off the carbon deposit on the surface of the porcelain insulator 1, rendering the spark plug highly resistant to fouling.

An experiment was also conducted to investigate the fouling resistance of the contemplated type of spark plug versus the diameter A of the central electrode 2, which was varied from 0.6 mm to 2.4 mm as shown in Table 5. Thus, eight samples of spark plug were prepared. The amount of projection H of the central electrode 2 was set at 1.8, and the diameter K of the end face of the porcelain insulator 1 was set equal to A+2.6, with 1.3 mm being secured for the wall thickness of the porcelain insulator 1. The semi-creep discharge air gap L was set at 0.4 and the thickness E of each ground electrode 11 at 1.6; as a result, the amount of projection J of each ground electrode was 2.0. The side electrode air gap G was set at 1.3.

The anti-fouling performance of the spark plug was evaluated by a so-called "pre-delivery fouling test". During its delivery from the assembly plant to a dealer, a car is driven many times for a very short distance each and the temperature of the spark plug remains at low level; therefore, the spark plug "smothers" and its insulation resistance decreases. This phenomenon is commonly called "pre-delivery fouling". The procedure of evaluating pre-delivery fouling is described in detail in JIS D 1606, "Smothering Fouling Test"; the car is placed in a cold test room at −10° C. and driven a specified number of cycles; in each cycle, the car is inched for several times of driving at low speed for several tens of seconds each; the insulation resistance of the spark plug was measured both in the middle and at the end of each cycle to evaluate its fouling resistance.

The results of the pre-delivery fouling test on an ignition system applying high positive voltage to the central electrode 2 are shown in Table 5 for various values of its diameter A.

TABLE 5

| Diameter A of central electrode | Rating |
|---|---|
| 0.6 mm | ◎ |
| 1.0 mm | ◎ |
| 1.2 mm | ◎ |
| 1.6 mm | ○ |
| 1.8 mm | ○ |
| 2.0 mm | ○ |
| 2.2 mm | Δ |
| 2.4 mm | X |

The respective criteria for rating shown in Table 5 have the following definitions: ◎, more than 20 cycles were required for the insulation resistance to drop to 10 MΩ; ○, 10–20 cycles were required; Δ, 5–10 cycles were required; Δ, the insulation resistance dropped below 10 MΩ in less than 5 cycles. As is clear from Table 5, the fouling resistance of the spark plug increases with decreasing diameter A of the central electrode 2. The diameter A of the central electrode 2 is preferably 2 mm or less, more preferably, 1.2 mm or less.

Figure 9:
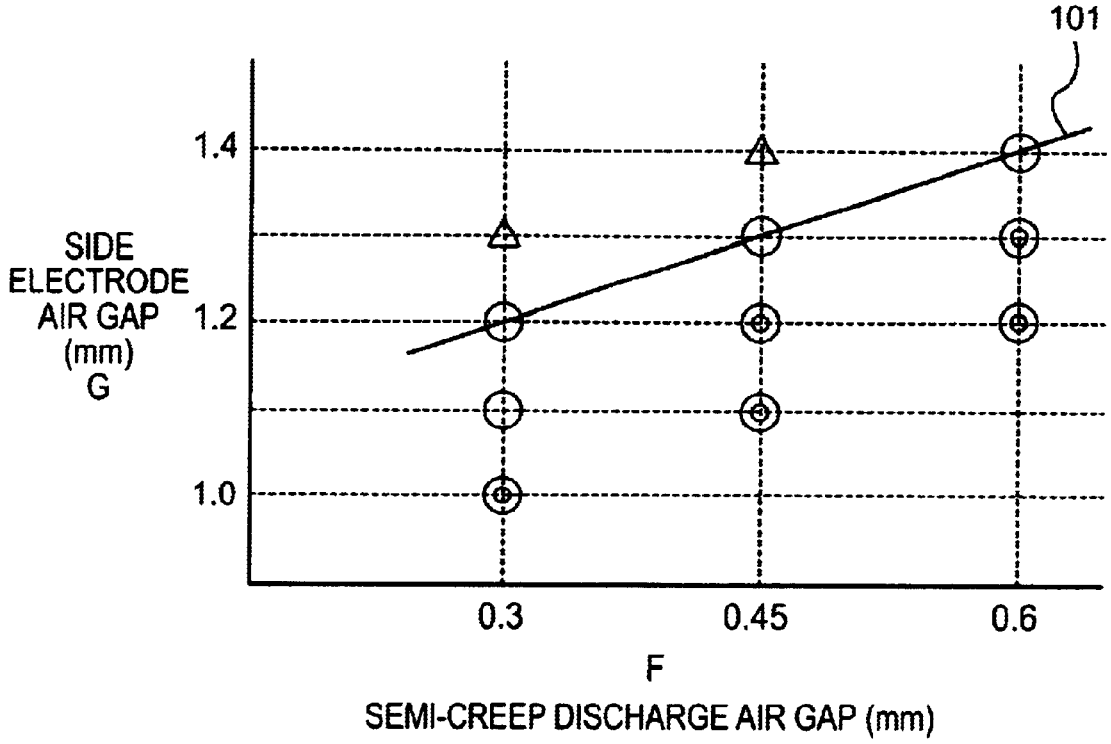
FIG. 9 is a graph showing the result of an experiment conducted to investigate the anti-channeling performance of the contemplated spark plug of the invention in terms of the relationship between the semi-creep discharge air gap L and the side electrode air gap G.

FIG. 9 is a graph showing the result of an experiment conducted to investigate the anti-channeling performance of the contemplated spark plug of the invention in terms of the relationship between the semi-creep discharge air gap L and the side electrode air gap G. The horizontal axis of the graph plots the semi-creep discharge air gap F and the vertical axis plots the side electrode air gap G. The symbols (◎, ○, Δ) in the graph represent the degree of channeling. The semi-creep discharge air gap L was adjusted to have one of the following three values, 0.3 mm, 0.45 mm and 0.6 mm, whereas the side electrode air gap G was adjusted to have one of five values between 1.0 mm and 1.4 mm; thus, a total of eleven spark plug samples were prepared. Since the thickness E of each ground electrode 11 was 1.6 mm, the amount of its projection J took the value 1.9 mm, 2.05 mm or 2.2 mm depending on the size of the semi-creep discharge air gap L. The foremost end of the central electrode 2 was adjusted to coincide in position with the front edge of the end face 11A of each ground electrode 11.

For anti-channeling performance evaluation, the central electrode 2 was connected to a positive terminal and high voltage with a peak of about 20 kV was applied intermittently for 500 h at a frequency of 60 Hz. The depth of the channeling groove in the surface of the porcelain insulator 1 was examined and measured with a scanning electron microscope. This experiment measured the degree of channeling due to the spark jumps along the end face of the porcelain insulator 1 that made no contribution to the spark cleaning of carbon fouling.

The results of the experiment are shown in FIG. 9 by rating according to the following criteria: ⊙, slight with the channeling groove depth being less than 0.2 mm; ○, moderate with groove depth of 0.2–0.4 mm; Δ, extensive with groove depth in excess of 0.4 mm. AS is clear from FIG. 9, the anti-channeling performance was satisfactory under the straight line 101. Since the straight line 101 can be expressed by the equation $G=(2/3)L+1.0$, the semi-creep discharge air gap L and the side electrode air gap G preferably satisfy the relation $G \leqq (2/3)L+1.0$ (in millimeters) to ensure the desired anti-channeling property.

Figure 10:
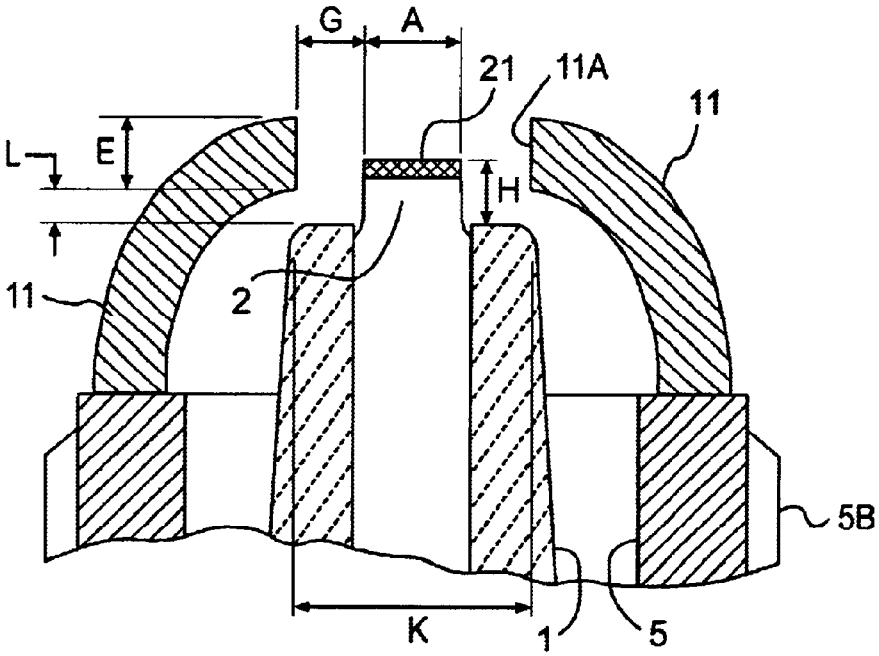
FIG. 10 shows in section the distal end portion of a spark plug of the third embodiment used in the ignition system according to the present invention.

FIG. 10 shows in section the distal end portion of a spark plug of the third embodiment used in the ignition system according to the present invention. A spark wear resistant member 21 in the form of a Pt disk is resistance welded to the tip of the central electrode 2 made of Inconel (trademark). The diameter A of the central electrode 2 is 2.0; the diameter K of the end face of the porcelain insulator 1 is 4.6; the thickness E of each ground electrode 11 made of 95 wt % of Ni is 1.6; the semi-creep discharge air gap L is 0.5; the side electrode air gap G is 1.3. The amount of projection H of the central electrode 2 is smaller than the value adopted in the second embodiment and takes 0.3, 0.5 or 1.0. Hence, three samples of spark plug were prepared for testing.

Figure 11:
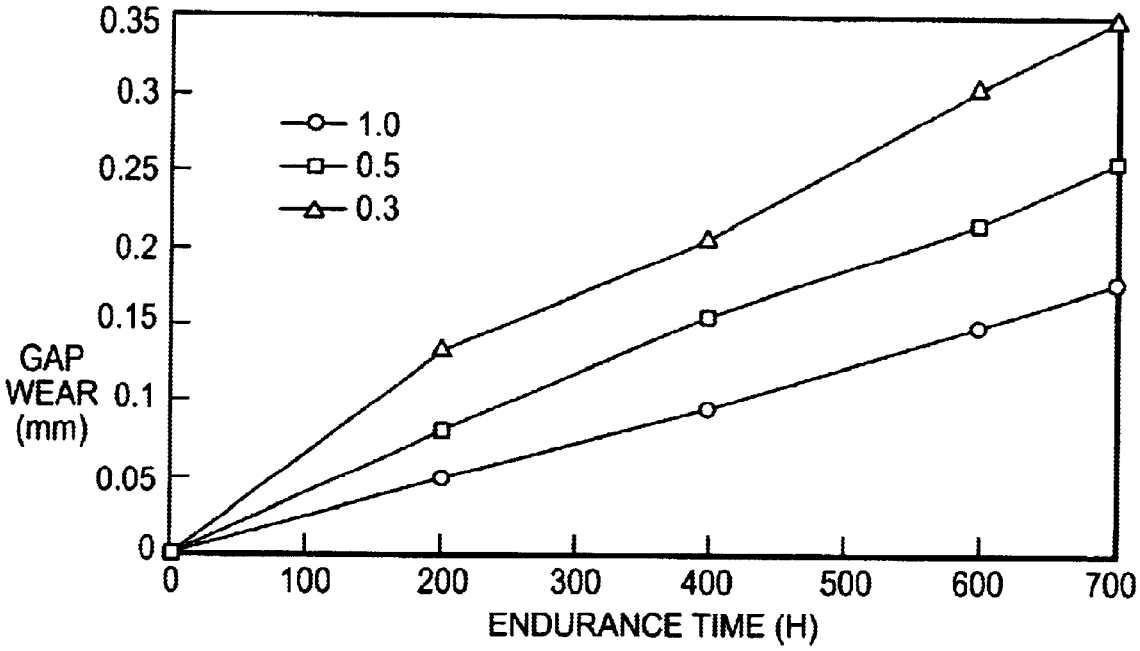
FIG. 11 is a graph showing the results of an on-board endurance test on the three spark plug samples.

FIG. 11 is a graph showing the results of an on-board endurance test on the three spark plug samples. The horizontal axis of the graph plots time and the vertical axis plots the gap wear or the increase in the side electrode air gap G. In the test, an in-line, 6-cylinder, 2-L engine was run at 5000 rpm and at full throttle (WOT, or wide open throttle). symbol A in the graph refers to the sample with H=0.3, symbol □ refers to the sample with H=0.5, and symbol ○ refers to the sample with H=1.0.

As is clear from FIG. 11, the sample with H=0.3 (Δ) in which the tip of the central electrode 11 was below the rear edge of the end face 11A (downward in FIG. 11) of each ground electrode 11 was the least durable and experienced the greatest amount of gap wear. More durable was the sample with H=0.5 (□). The sample with H=1.0 (○) in which the tip of the central electrode 2 was between the front and rear edges (upward and downward in FIG. 11) of the end face 11A of each ground was the most durable and experienced the smallest amount of gap wear. These test results show that it is preferable from a durability view point that the tip surface of the central electrode 2 is positioned in the side of the distal end in comparison with the rear edge of the end face of each ground electrode 11.

Figure 12:
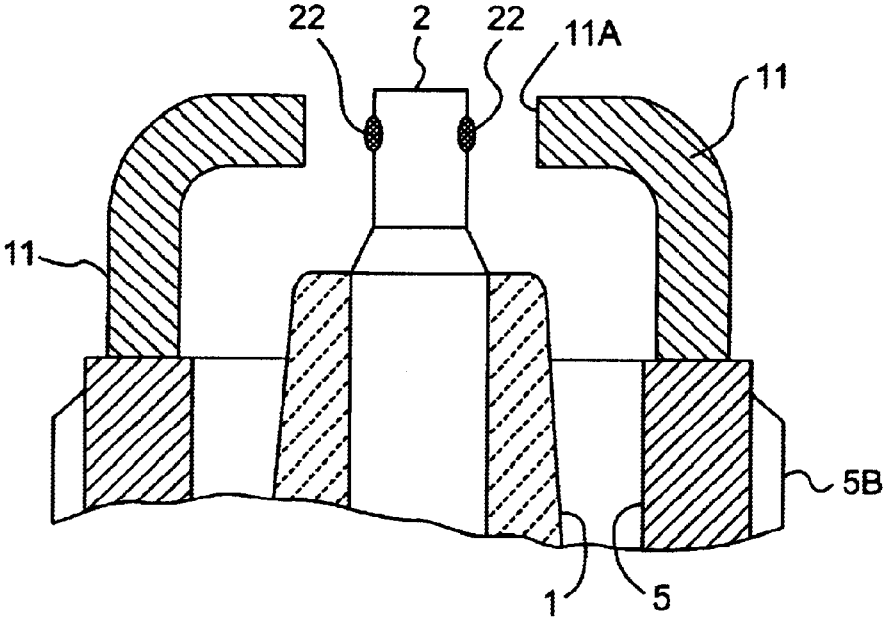
FIG. 12 shows in section the distal end portion of a spark plug of the fourth embodiment used in the ignition system according to the present invention.

FIG. 12 shows in section the distal end portion of a spark plug of the fourth embodiment used in the ignition system according to the present invention. Unlike in the case where the spark wear resistant member 22 is secured to the entire peripheral side of the small-diameter portion of the central electrode 2, a chip of spark wear resistant member 22 in the form of a Pt disk is laser welded to two areas of the small-diameter portion that are opposed to the end faces IIA of the ground electrodes 11 where most of the spark jumps are likely to occur. This fourth embodiment has the advantage of using a smaller amount of the expensive spark wear resistant member.

Figure 13:
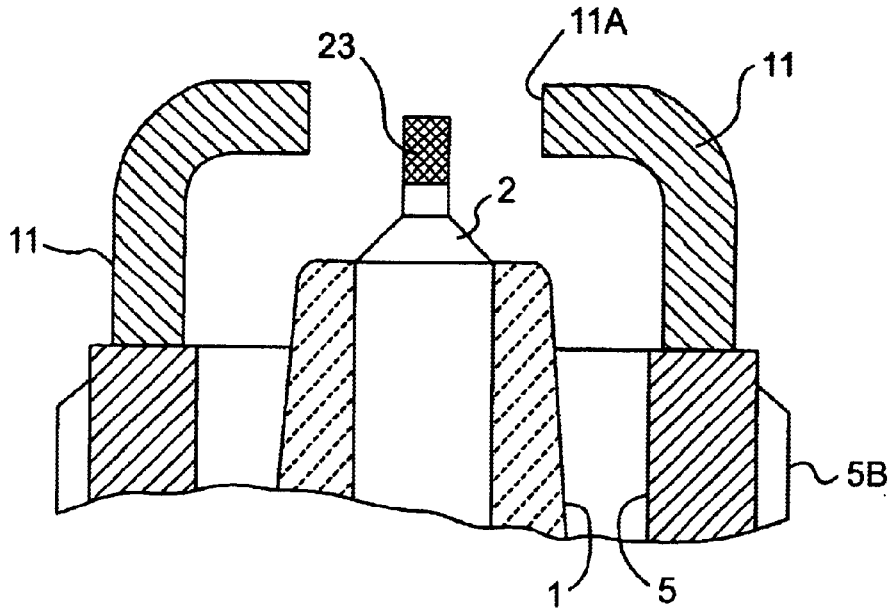
FIG. 13 shows in section the distal end portion of a spark plug of the fifth embodiment used in the ignition system according to the present invention.

FIG. 13 shows in section the distal end portion of a spark plug of the fifth embodiment used in the ignition system according to the present invention. A chip of spark wear resistant member 23 in the form of a Pt cylinder is laser welded to the distal end of the smaller-diameter portion of a central electrode body 2 made of Inconel, thereby making the central electrode. The most distal end of the chip 23 is located between the front and rear edges of the end face 11A of each ground electrode 11. This fifth embodiment of the invention has the advantage of not only retarding the wear of the central electrode but also making the smaller-diameter portion 23 of the central electrode even thinner to achieve a further decrease in the discharge voltage. As an additional advantage, the efficiency of spark jumping at the tip of the central electrode is enhanced to provide more efficient firing.

Figure 14:
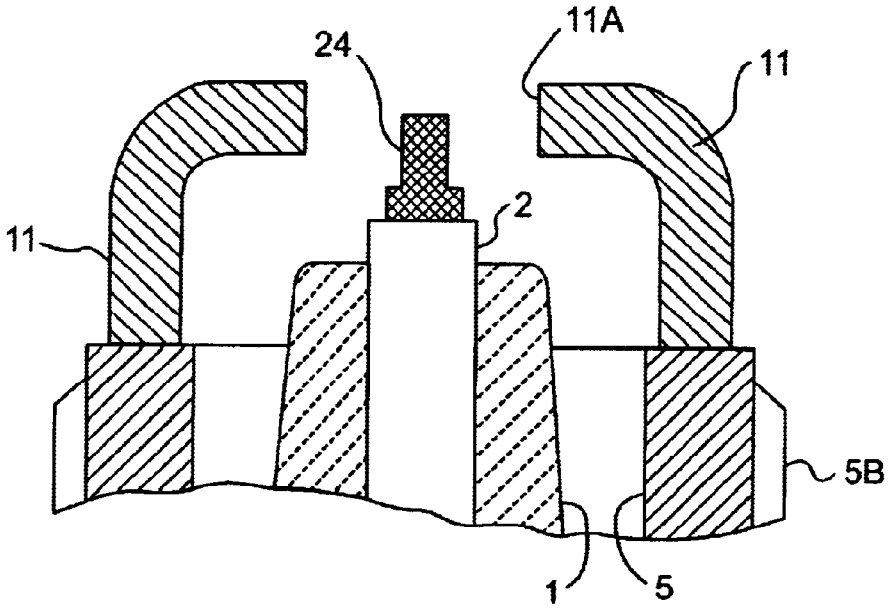
FIG. 14 shows in section the distal end portion of a spark plug of the sixth embodiment used in the ignition system according to the present invention.

FIG. 14 shows in section the distal end portion of a spark plug of the sixth embodiment used in the ignition system according to the present invention. A chip of spark wear resistant member 24 in platinum that consists of an upper, smaller-diameter cylinder and a lower, larger-diameter cylinder is resistance welded to the tip of a central electrode body 2 made of Inconel having an even larger diameter, thereby making the central electrode. The smaller-diameter portion of the chip 24 provides a jump sparking tip. The most distal end of the chip 24 is located between the front and rear edges of the end face 11A of each ground electrode 11. This sixth embodiment of the present invention has the advantage of ease in manufacture since there is no need to reduce the diameter of a selected area of the central electrode body 2.

FIG. 15 shows in section the distal end portion of a spark plug used for the ignition system according to the seventh embodiment of the present invention. A chip of spark wear resistant member 25 in the form of a Pt cylinder is laser welded to the distal end of the smaller-diameter portion of a central electrode body 2 made of Inconel, thereby making the central electrode. The most distal end of the chip 25 is located between the front and rear edges of the end face 11A of each ground electrode 11. A rectangular sheet of spark wear resistant member 26 is resistance welded to the mating end faces of the ground electrodes 11. This seventh embodiment of the present invention has the advantage that not only the central electrode but also the ground electrodes 11 wear so slowly that the durability of the spark plug is further improved.

Figure 16:
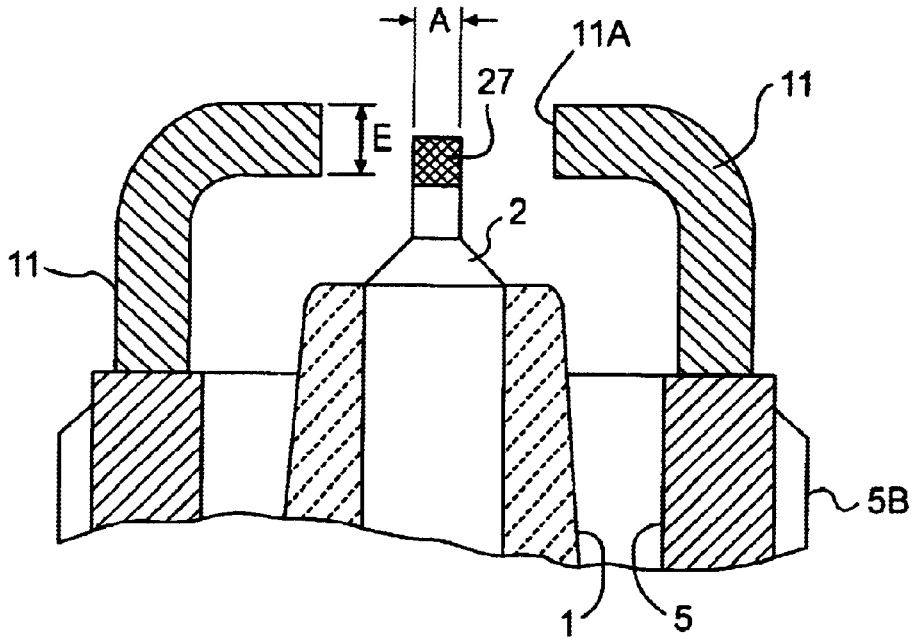
FIG. 16 shows in section the distal end portion of a spark plug used for the ignition system according to the eighth embodiment of the present invention, in which the concept of the invention is applied to spark plugs of small diameters such as M10S and M8S.

FIG. 16 shows in section the distal end portion of a spark plug used for the ignition system according to the eighth embodiment of the present invention, in which the concept of the invention is applied to spark plugs of small diameters such as M10S and M8S. A chip of spark wear resistant member 27 in the form of a Pt cylinder is laser welded to the distal end of the smaller-diameter portion of a central electrode body 2 made of Inconel, thereby making the central electrode. The diameter A of chip 27 is 0.8 mm; the thickness E of the end face 11A of each ground electrode 11 is 1.1 mm and its width w (not shown) is 2.2 mm. With such small-diameter spark plugs, the outside ground electrodes 11 cannot have an adequate cross-sectional area. However, according to the eighth embodiment of the invention, the diameter of the distal end portion of the central electrode 2 and, hence, its projection from the porcelain insulator 1 can be reduced; as a result, the projection of the ground electrodes 11 from the main metallic shell 5 is sufficiently reduced to ensure that they have an adequate strength for practical purposes.

Figure 17:
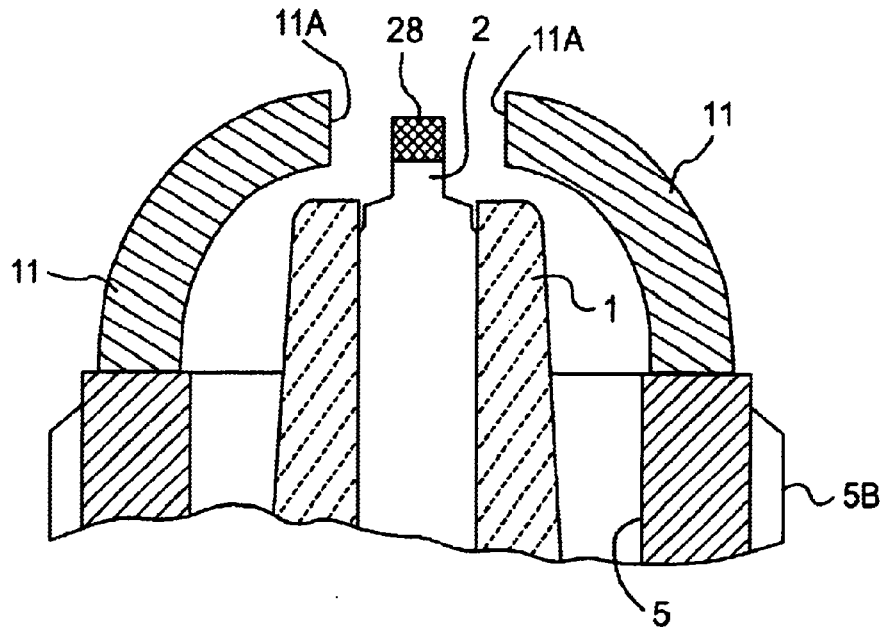
FIG. 17 shows in section the distal end portion of a spark plug used for an ignition system according to the ninth embodiment of the present invention, in which the concept of the present invention is applied to spark plugs of an intermittent, semi-creep discharge type.

FIG. 17 shows in section the distal end portion of a spark plug used for an ignition system according to the ninth embodiment of the present invention, in which the concept of the present invention is applied to spark plugs of an intermittent, semi-creep discharge type. A chip of spark wear resistant member 28 in the form of a Pt cylinder is laser welded to the distal end of the smaller-diameter portion of a central electrode body 2 made of Inconel, thereby making the central electrode. Two outside ground electrodes 11 made of 95 wt % of Ni are provided in such a way that their end faces 11A are opposed to the peripheral side of the chip 28, with the edge of the rear end (downward in FIG. 17) of each end face 11A is reasonably close to the end face of the porcelain insulator 1. This design has the advantage that if the surface of the porcelain insulator 1 is fouled by carbon, a spark jumps from the rear edge of the end face 11A of each outside ground electrode 11 to the end face of the porcelain insulator 1 to thereby "spark clean" its surface. In other words, the spark plug according to the ninth embodiment of the present invention has an effective anti-fouling property. It also retains the essential features of the invention, i.e., the small diameter of the distal end 28 of the central electrode, efficient firing, and high durability.

Figure 18:
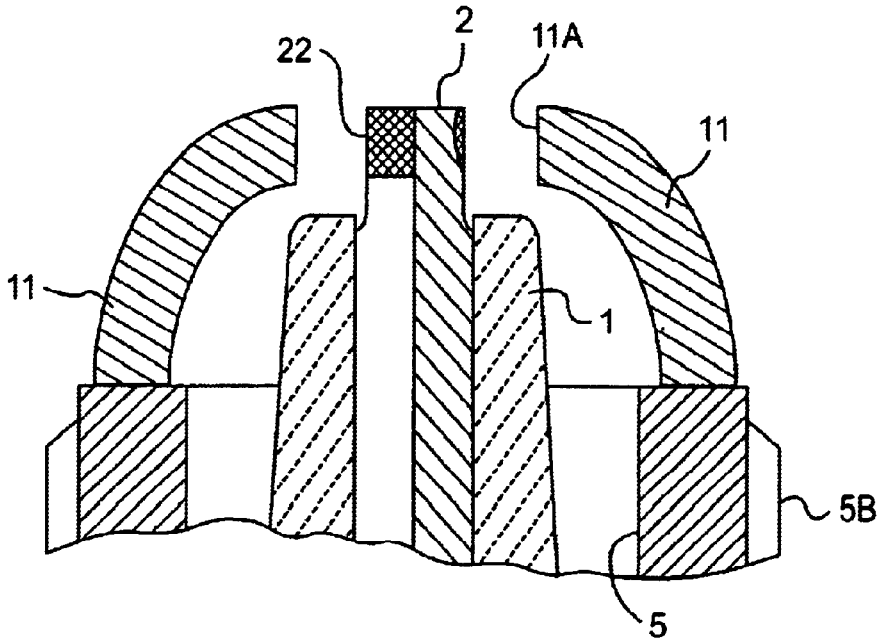
FIG. 18 shows in section the distal end portion of a spark plug used for the ignition system according to the tenth embodiment of the present invention.

FIG. 18 shows in section the distal end portion of a spark plug used for the ignition system according to the tenth embodiment of the present invention. In this intermittent semi-creep discharge spark plug, a spark wear resistant member 29 in the form of a Pt disk is laser welded not to the tip surface but the peripheral side of the central electrode 2 made of 95 wt % of Ni. The spark wear resistant member 29 extends to the foremost end of the central electrode 2. The dimensions of the respective parts shown in FIG. 18 are generally the same as in the first embodiment. Even in the tenth embodiment, the spark plug used at positive polarity has an improved ratio of spark jumps in the distal end portion of the central electrode 2, making it practically suitable for use as an intermittent semi-creep discharge spark plug having high resistance to channeling. In addition, the spark wear resistant member 29 fitted in the distal end portion of the central electrode 2 increases the durability of the spark plug.

Figure 19:
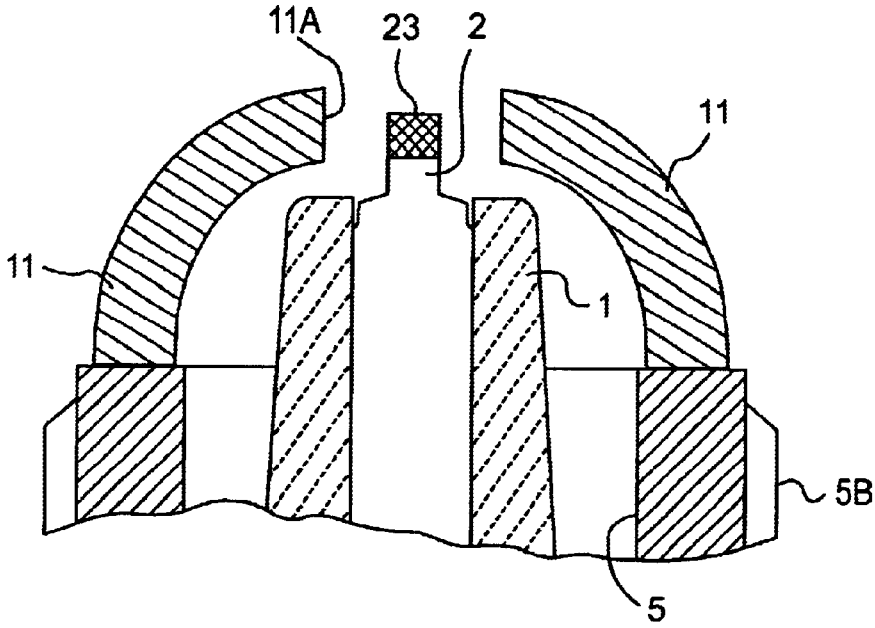
FIG. 19 shows in section the distal end portion of a spark plug used for the ignition system according to the eleventh embodiment of the present invention.

FIG. 19 shows in section the distal end portion of a spark plug used for the ignition system according to the eleventh embodiment of the present invention. In this intermittent semi-creep discharge spark plug, the central electrode body 2 made of Inconel is reduced in diameter in the portion that projects from the porcelain insulator 1. A chip of spark wear resistant member 201 in the form of a Pt cylinder is resistance welded to the distal end of the reduced-diameter portion of the central electrode body 2, whereby the central electrode is made up of the chip 201 and the central electrode body 2. The foremost end of the central electrode (the distal end of the chip 201) is located between the front and rear edges of the end face 11A of each ground electrode 11. According to the eleventh embodiment, the distal end portion of the central electrode can be reduced in diameter without sacrificing the overall strength of the central electrode and the reduced diameter contributes to enhance the anti-fouling property of the spark plug by increasing the efficiency of spark cleaning during creep discharge. As a further advantage, the Pt chip 201 fitted in the distal end portion of the central electrode contributes to reduce spark wear.

Figure 20:
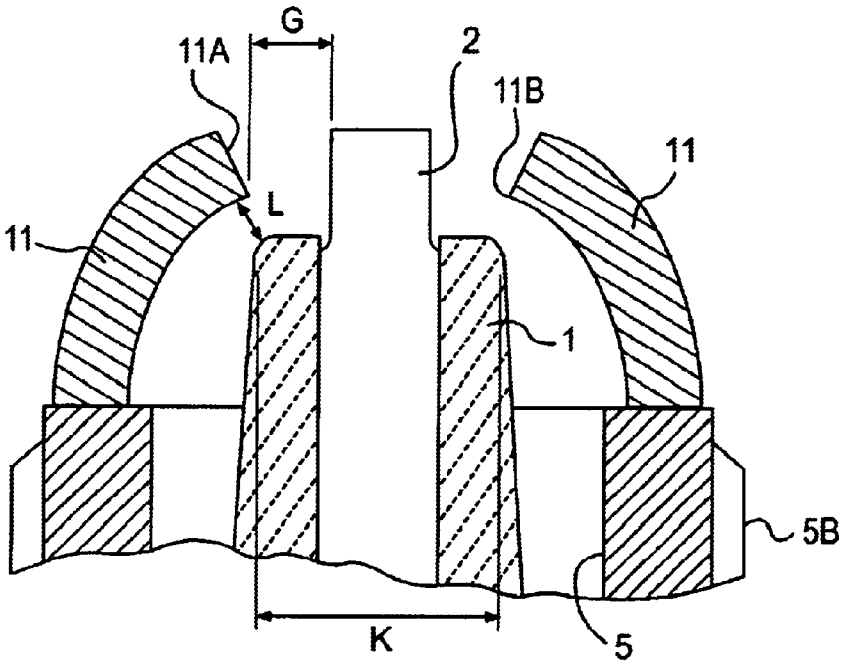
FIG. 20 shows in section the distal end portion of a spark plug used for the ignition system according to the twelfth embodiment of the present invention.

FIG. 20 shows in section the distal end portion of a spark plug used for the ignition system according to the twelfth embodiment of the present invention. In this spark plug, the end face 11A of the ground electrode 11 obliquely opposes to the peripheral side face of the central electrode 2 having no spark wear resistant member. The shortest distance G from the end edge 11B at the bottom side of the drawing of the end face 11A of the ground electrode 11 to the peripheral side face of the central electrode 2 is formed to be 1.5 times or more than the shortest distance L from the ground electrode 11 to the porcelain insulator 1. Further, the diameter K of the end face of the porcelain insulator 1 is 4.6; the thickness E of the ground electrode 11 made of 95 wt % of Ni is 1.6; the semi-creep discharge air gap L is 0.5; and the side electrode air discharge gap G is 1.5. Incidentally, the central electrode 2 is formed of 95 wt % of Ni. Other elements are similar to those of the third embodiment.

Figure 21:
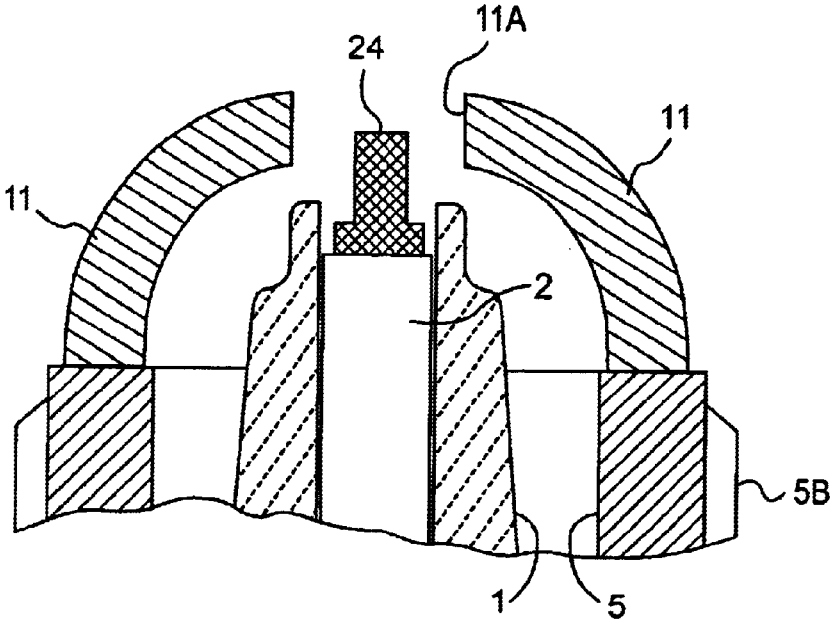
FIG. 21 shows in section the distal end portion of a spark plug used for the ignition system according to the thirteenth embodiment of the present invention.

FIG. 21 shows in section the distal end portion of a spark plug used for the ignition system according to the thirteenth embodiment of the present invention.

As shown, a central electrode body 2 made of Inconel (trademark) is recessed into a porcelain insulator 1. A spark wear resistant member 202 in the form of a Pt cylinder is resistance welded to the tip surface of the recessed central electrode body 2. The cylindrical member 202 consists of an upper small-diameter portion and a lower large-diameter portion. The tip surface of the small-diameter portion of the cylindrical member 202 is located between the front and rear edges of the end face 11A of each ground electrode 11 made of 95 wt % of nickel. The central electrode body 2 and the spark wear resistant member 202 combine to form the central electrode. This design provides relative ease in fabricating a central electrode that has a thin, spark jumping portion and which yet has high spark resistance.

Figure 22:
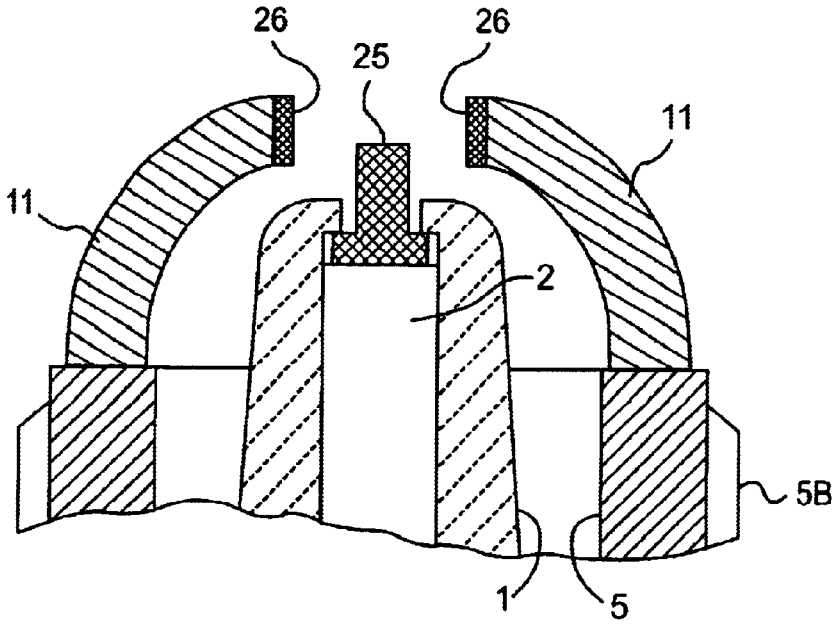
FIG. 22 shows in section the distal end portion of a spark plug used for the ignition system according to the fourteenth embodiment of the present invention.

FIG. 22 shows in section the distal end portion of a spark plug used for the ignition system according to the fourteenth embodiment of the present invention. As shown, a central electrode body 2 made of Inconel (trademark) is recessed in a porcelain insulator 1. A spark wear resistant member 203 in the form of a Pt cylinder is resistance welded to the tip surface of the recessed central electrode body 2. The cylindrical member 203 consists of an upper small-diameter portion and a lower large-diameter portion. The end face portion of the porcelain insulator 1 is so formed as to conceal the central electrode body 2 and the lower large-diameter portion of the cylindrical spark wear resistant member 203. The small-diameter distal end portion of the spark wear resistant member 203 projects from the end face of the porcelain insulator 1 such that its tip surface is located between the front and rear edges of the end face of each ground electrode 11 made of Inconel (trademark). The central electrode body 2 combines with the spark wear resistant member 203 to form the central electrode.

Figure 23:
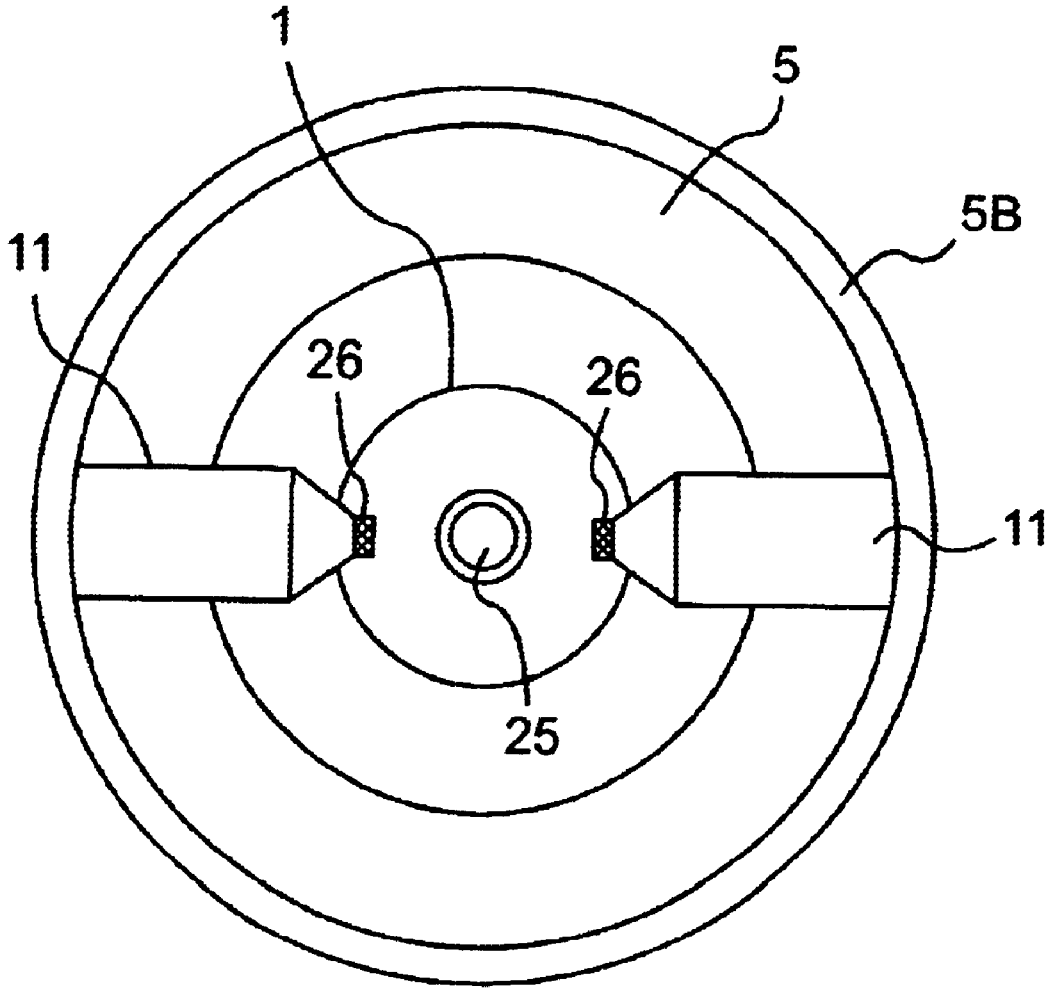
FIG. 23 is a plan view of the distal end portion of the spark plug used for the ignition system according to the fourteenth embodiment of the present invention which is shown in FIG. 22.
Figure 24:
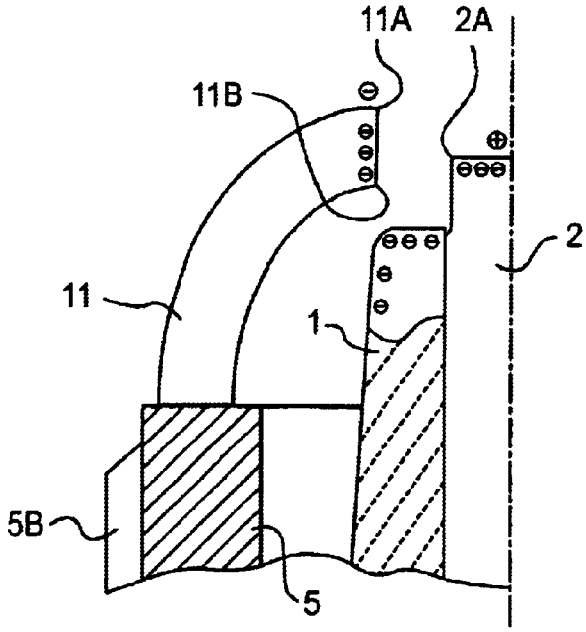
FIG. 24 is a section view of the distal end portion of a spark plug in which positive high voltage is applied to a central electrode.
Figure 25:
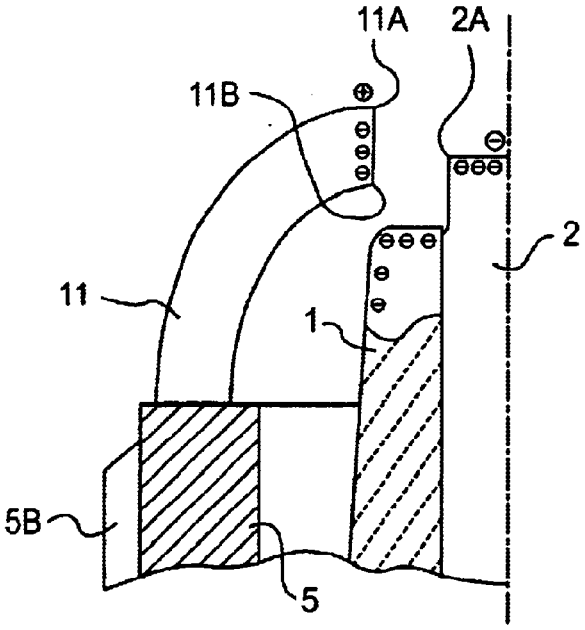
FIG. 25 is a section view of the distal end portion of a spark plug in which negative high voltage is applied to a central electrode.

FIG. 23 is a plan view of the distal end portion of the spark plug used for the ignition system according to the fourteenth embodiment of the present invention which is shown in FIG. 22. The distal end of each ground electrode 11 is tapered like a wedge and a prismatic spark wear resistant member 204 made of Pt is secured to the tip. The spark wear resistant member 204 on each ground electrode is opposed to the peripheral side of the spark wear resistant member 203 serving as part of the central electrode. In the fourteenth embodiment, the central electrode and each ground electrode have the spark wear resistant members 203 and 204, respectively, in the spark jumping portion; thus, both the spark jumping portion 203 of the central electrode and the spark jumping portion 204 of each ground electrode have sufficient spark wear resistance to increase the durability of the spark plug. In addition, the end face of the porcelain insulator 1 has a larger area than the spark plug according to the thirteenth embodiment shown in FIG. 21 and, hence, the spark plug of the fourteenth embodiment has higher resistance to fouling.

What is claimed is:

1. An ignition system comprising:

a plurality of spark plugs each comprising a central electrode, a porcelain insulator for holding the central electrode, a main metallic shell for holding the porcelain insulator, and a ground electrode electrically connected to the main metallic shell; and a positive voltage applying unit for applying only a positive voltage to the central electrode of each of the spark plugs in comparison with the ground electrode at spark discharge of the spark plugs, so that an ignition high voltage is applied between the central electrode and the ground electrode wherein a spark discharge gap is formed between the ground electrode and a distal end portion of the central electrode, the distal end portion has a relatively reduced cross-section, and the ground electrode includes a mating face that has a distal front edge and a proximal rear edge, the rear edge of the mating face is directly opposed to a peripheral side of the central electrode and is positioned confronting the distal end of the central electrode in comparison with the porcelain insulator.

2. The ignition system according to claim 1, wherein the distal end portion of the central electrode, where the peripheral side of the central electrode is opposed to the ground electrode, has a diameter of 2.0 mm or less.

3. The ignition system according to claim 2, wherein the diameter of the distal end portion of the central electrode is in the range of 0.6 mm to 1.8 mm.

4. The ignition system according to claim 1, wherein the shortest distance (G) from the mating face of the ground electrode to the central electrode is at least 1.5 times as long as the shortest distance (L) from the ground electrode to the porcelain insulator ($1.5L \leqq G$).

5. The ignition system according to claim 1, wherein the distal end face of the central electrode is located between the front and rear edges of the mating face of the ground electrode.

6. The ignition system according to claim 1, wherein the shortest distance (L) from the ground electrode to the porcelain insulator is between 0.3 mm and 0.6 mm ($0.3 \leqq L \leqq 0.6$), and the shortest distance (G) from the mating surface of the ground electrode to the peripheral side of the central electrode is $G \leqq (2/3)L+1.0$ (in millimeters).

7. The ignition system according to claim 1, wherein the central electrode has a spark wear resistant member in at least a part of its distal end portion.

8. The ignition system according to claim 7, wherein the spark wear resistant member on the central electrode extends to a position more rearward of the rear edge of the mating face of the ground electrode.

9. The ignition system according to claim 1, wherein the ground electrode has a spark wear resistant member in at least a part of its mating face.

10. The ignition system according to claim 1, wherein the positive voltage applying unit comprises an ignition coil having a primary coil and a secondary coil, and a primary current flowing in the primary coil of the ignition coil is stopped at a predetermined ignition period so as to apply the ignition high voltage is applied between the central electrode and the ground electrode of the spark plug.

11. The ignition system of claim 1, further comprising:

a combustion chamber configured to create a swirl of air fuel mixture therein during operation, wherein the ground electrode is positioned in the combustion chamber such that the ground electrode does not shield the central electrode from the swirl of air fuel mixture.

12. The ignition system of claim 1, further comprising:

a combustion chamber configured to create a swirl of air fuel mixture therein during operation, wherein the mating face of the ground electrode is substantially collinear with a portion of the swirl of air fuel mixture during operation.

* * * * *